United States Patent [19]

Takagi et al.

[11] Patent Number: 4,939,067

[45] Date of Patent: Jul. 3, 1990

[54] SILVER HALIDE PHOTOGRAPHIC MATERIALS

[75] Inventors: Yoshihiro Takagi; Shingo Nishiyama, both of Kanagawa, Japan

[73] Assignee: Fuji Photo Film Co., Ltd., Kanagawa, Japan

[21] Appl. No.: 199,828

[22] Filed: May 27, 1988

[30] Foreign Application Priority Data

May 28, 1987 [JP] Japan ..... 62-133020

[51] Int. Cl.[5] ..... G03C 1/10

[52] U.S. Cl. ..... 430/264; 430/567; 430/569; 430/598; 430/606; 430/615

[58] Field of Search ..... 430/567, 264, 569, 598, 430/606, 615

[56] References Cited

U.S. PATENT DOCUMENTS

| | | | |
|---|---|---|---|
| 4,564,591 | 1/1986 | Tanaka et al. | 430/567 |
| 4,643,966 | 2/1987 | Markasky et al. | 430/567 |
| 4,659,647 | 4/1987 | Vacca et al. | 430/567 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

An ultra-high contrast silver halide photographic material which is suitable for daylight use and which has at least one silver halide emulsion layer on a support, wherein the emulsion layer contains cubic silver halide grains having a mean grain size of 0.15 μm or less and containing silver chloride in an amount of 99 mol % or more. The material can contain a rhodium salt or an organic desensitizer for lowering the sensitivity while maintaining the high contrast photographic property thereof.

20 Claims, No Drawings

SILVER HALIDE PHOTOGRAPHIC MATERIALS

FIELD OF THE INVENTION

The present invention relates to silver halide photographic materials, in particular to those for use in a photomechanical process, and more precisely to ultra-contrast negative photographic materials suitable for daylight use.

BACKGROUND OF THE INVENTION

In the field of graphic arts, an image-formation system with an ultra-contrast photographic characteristic (especially having a gamma value of 10 or more) is required so as to improve the reproduction of images with a continuous gradation of half-tone images or improve the reproduction of line images.

Hitherto, a particular developer, which is called a lith-developer, has been utilized for said purpose. A lith-developer contains only hydroquinone as a developing agent, where a sulfite, which is a preservative, is incorporated in the form of an adduct with formaldehyde in order not to interfere with the infectious developability thereof so that the concentration of the free sulfite ion in the developer is made extremely low (generally 0.1 mol/liter or less). Accordingly, the lith-developer is extremely easily subjected to aerial oxidation and therefore has a serious defect in that it is not durable to storage for a period of time of longer than 3 days.

As a method of obtaining a high-contrast photographic characteristic, there are methods of using a hydrazine derivative, for example, as described in U.S. Pat. Nos. 4,224,401, 4,168,977, 4,166,742, 4,311,781, 4,272,606, 4,211,857, 4,243,739, etc. According to the said methods, a high-contrast and high-sensitive photographic characteristic can be obtained and a sulfite of a high concentration can be added to the developer. As a result, the stability of the developer against aerial oxidation may remarkably be improved as compared with a lith-developer. However, when an ultra-contrast image is formed by the use of a hydrazine compound, there may be various problems of pH fluctuation by processing fatigue or aerial fatigue, as well as lowering of the density or softening of the contrast because of a decrease of the activity of the developing agent or because of accumulation of inhibitor. Accordingly, means of enhancing the hydrazine-caused hard contrast are strongly desired, and various contrast-enhancing agents have been proposed. For example, Japanese Patent Application (OPI) No. 167939/86 (the term "OPI" as used herein means a "published unexamined Japanese Patent Application") illustrates phosphonium salt compounds, Japanese Patent Application (OPI) No. 198147/86 illustrates disulfide compounds and Japanese Patent Application (OPI) No. 140340/85 illustrates amine compounds, as a contrast-enhancing agent. However, even though these compounds are used, it is still impossible to prevent the softening of the contrast of hard photographic materials during the processing thereof.

On the other hand, daylight photographic materials with low sensitivity can be obtained by the use of a hydrazine compound. For example, Japanese Patent Application (OPI) Nos. 83038/85 and 162246/85 illustrate water-soluble rhodium salt-containing silver halide photographic materials. However, when a sufficient amount of rhodium for lowering the sensitivity is added, the contrast enhancement by the hydrazine compound is thereby inhibited so that a desired sufficiently high contrast image can not be obtained.

Japanese Patent Application (OPI) No. 157633/84 mentions a method of preparing a silver halide photographic material which contains a water-soluble rhodium salt in an amount of from $10^{-8}$ to $10^{-5}$ mol per mol of silver halide and an organic desensitizing agent having a positive sum of anode potential and cathode potential by polarography. However, according to the method, although the sensitivity can be lowered, it is impossible to obtain a sufficiently high contrast image for practical use in the industrial field.

Japanese Patent Application (OPI) No. 62245/81 discloses a method of forming a high contrast image in which the development is conducted in the presence of tetrazolium compound so that the development in the part of the toe of the characteristic curve is inhibited by the tetrazolium compound. However, the tetrazolium compound-containing silver halide photographic material has some problems in that the material deteriorates during storage so that only a soft image can be obtained and the reaction product of the tetrazolium compound by development partly remains in the film so as to cause film-staining or development unevenness.

Thus, the method of increasing the contrast of photographic materials by the use of a hydrazine compound is always accompanied by the problem of the softening of the contrast thereof, and for example, the contrast would often soften during a running processing operation or by addition of a rhodium salt and/or an organic desensitizing agent so as to obtain a low sensitive image. That is, it is extremely difficult to desensitize the ultra-contrast image formed by the use of a hydrazine compound while maintaining the high contrast of the image.

As the case may be, a large amount of a hydrazine compound is often added so as to attain the high contrast. As a result, the strength of the emulsion film is weakened, the storage stability is worsened or a noticeably amount of the hydrazine compound is released into the developer during the running processing operation so that the processing solution is stained by the hydrazine compound or the photographic material processed is badly affected by the compound. Accordingly, a method of accelerating the high contrast of photographic materials by the use of a small amount of a hydrazine compound is also desired.

As mentioned above, it is extremely difficult to lower the sensitivity of the photographic material which has been made high in contrast by addition of a hydrazine compound while maintaining the high contrast of the material. This is because of the following reasons: The hydrazine compound participates in the development of the photographic material so as to induce nucleating infectious development, by the electron-donating capacity thereof, to silver halide to thereby give a high contrast image, while the organic desensitizing agent or inorganic desensitizing agent, such as rhodium salts, is a photoelectroreceptor. This has a function of receiving a photoelectron during image exposure to prevent latent image formation, thereby lowering the sensitivity of the photographic material. On the other hand, the desensitizing agent can receive the electrons as donated by the electron-donating agent, such as hydrazine compounds, so as to inhibit nucleating infectious development by the agent and, as a result, a high contrast image can not be obtained. Accordingly, a method of desensitizing a high contrast photographic material containing a hydrazine compound while maintaining the high contrast of the material is strongly desired.

In the reversing step field of graphic arts, a photographic light-sensitive material having a photographic characteristic with a gradation of a gamma value of from 4 to 8 or so is used in addition to the photographic material with an ultra-contrast contrast gradation (gamma value of 10 or more). The former photographic material with such a gradation has less problems of pin holes because of dust and white spots (tape-adhered spots) due to adhesive tapes applied for fixation of an original thereto, than the latter ultra-contrast photographic material, during contact the reversing step. On the other hand, the former has a defect in that the sharpness of letters or half-tone images to be formed thereon is inferior to that of images to be formed on the latter. For practical use, it is necessary to keep an image sharpness of some degree, and for this, the gamma value is required to fall within the range of from 3.5 to 8 or so. For daylight room use, the sensitivity of the photographic materials is required to be lowered. It may be possible to lower the sensitivity by incorporation of a rhodium salt into the silver halide grains in the photographic material. However, this lowers the gamma value of the material so that the image sharpness thereof is lost. When a dye is used for lowering the sensitivity, the anti-irradiation effect of the dye causes another problem in that the tone adjustment of the half-tone images or the line width adjustment of the linear images in accordance with the exposure amount becomes difficult.

Accordingly, a method of lowering only the sensitivity without lowering the gamma value is strongly desired.

For reversal photographic materials, the processed film is used as an original and subjected to contact printing with an Hg printer, or is printed to a printing plate such as PS plate with an ultraviolet ray in the post-step. Accordingly, these are required to have a high ultraviolet density, or on the contrary, there is a desire to reduce the amount of the silver to be coated thereon as little as possible for the purpose of economizing the natural resources. Under the circumstances, a method of obtaining a higher ultraviolet density with a reduced silver amount coated is strongly desired.

In order to overcome the above-mentioned problems, a method of using fine silver halide grains consisting essentially of silver chloride was found effective. However, this method has the following problems.

Cubic silver chlorobromide or silver chloride grains having a mean grain size of more than 0.15μ and containing 99 mol % or more AgCl have too high a sensitivity for a daylight photographic material. When a rhodium salt is added, the Dmax is difficult to appear; and when a nucleating agent is added, the nucleating development is difficult to proceed. Anyhow, these systems are defective since the contrast is soft.

Japanese Patent Application (OPI) No. 140338/85 mentions a method of using silver halide grains having a mean grain size of 0.15μ or less, but it is silent about cubic silver chlorobromide or silver chloride grains having a mean grain size of 0.15μ or less and containing 99 mol % or more silver chloride. This is because such cubic grains have a high solubility and therefore are difficult to prepare.

Silver chlorobromide grains containing bromine in an amount of 2 mol % or more, even having a mean grain size of 0.15μ or less, have a defect in that the grains are often fogged with ease when processed in the presence of a UV-cut fluorescent light or a white fluorescent light because of the prolonged long wavelength edge of the absorption wavelength.

Spherical or roundish grains having a mean grain size of 0.15μ or less and containing 99 mol % or more AgCl have a defect in that the contrast is often softened when a large amount of rhodium is added to the system of the grains to which a nucleating agent has been added so as to lower the sensitivity thereof.

For silver chlorobromide or silver chloride grains having a mean grain size of 0.15μ or less and containing bromine in an amount of 1% or less, there is not known any method for stably preparing the grains since the grains have a high solubility.

In particular, silver halide grains consisting essentially of silver chloride and having a mean grain size of 0.15μ or less have a high solubility. Therefore, when the grains are prepared, the temperature for grain formation is lowered or the speed of adding raw material components is accelerated so as to minimize the grain size. However, even under such grain formation conditions, the grains are often forced to be physically ripened during the grain formation or after the grain formation and, in particular, the grain size becomes large or the grains are deformed in the subsequent desalting step (flocculation, and rinsing-in-water step) or in the post-ripening step thereafter. Such is defective and problematic. When the grain formation is conducted under the condition of a temperature of 30° C. or less, the temperature is hardly controlled to be constant in view of the manufacture operation of the grains. Accordingly, a method capable of stably preparing the grains is desired.

In the preparation of fine cubic-silver chloride grains, the grain size fluctuation is noticeable after the formation of the grains or in the subsequent desalting step or in the post-ripening step. In order to prevent such grain size fluctuation, a compound capable of adsorbing to the surface of the silver halide grains may be added as a grain growth inhibitor. Although the grain size fluctuation is somewhat inhibited by the addition of such an inhibitor, the crystal habit of the resulting grains problematically varies. Accordingly, a method capable of preparing silver halide grains while maintaining the size and the crystal habit (cubic crystal) is desired.

On the other hand, the grain growth inhibitor is generally a compound which is called an antifoggant or stabilizer. Therefore, when silver halide grains are prepared in the presence of the inhibitor and the inhibitor still remains in the resulting emulsion after rinsing-in-water, the successive chemical ripening with a chemical sensitizer in the post-ripening step is extremely retarded because of the inhibitor remaining in the emulsion, or the photographic sensitivity or Dmax is lowered to a degree of no practical use, or the adsorption of the spectral sensitizing dye to the emulsion is extremely retarded. Such are serious problems and so means of overcoming these problems are earnestly desired.

Silver chloride grains having a mean grain size of 0.15μ have a problem in that they often cause development unevenness in the development step. In particular, roller-squeezing unevenness in the development part in an automatic developing machine is one great problem. This is considered also because of the high solubility of the grains. The phenomenon is extremely remarkable in a fine silver chloride grain emulsion. Accordingly, means of overcoming such problematic phenomenon are strongly desired.

When a prepared stock emulsion is stored in a refrigerator for a long period of time, the grain size is often enlarged or the grains are often deformed in the case of silver halide grains having a mean grain size of 0.15μ or less and containing 99 mol % or more silver chloride. Accordingly, there is a great problem in the storage stability of the stock emulsion of the silver halide grains.

When the stock emulsion is dissolved and then stored for a long period of time (2 to 10 hours) in the state of a coating solution as dissolved, the grains in the resulting solution are physically ripened so that the grain size becomes large and the grains are deformed. Thus, the photographic property of the coating solution varies. These are serious problems.

Anyhow, the silver halide grains having a mean grain size of 0.15μ or less and containing 99 mol % or more silver chloride have various problems in that the grain size is enlarged or the grains are deformed because of the extremely high solubility of the grains. Therefore, means of overcoming these problems are strongly desired.

SUMMARY OF THE INVENTION

The first object of the present invention is to provide a silver halide photographic material having a high covering power.

The second object of the present invention is to provide a photographic light-sensitive material containing one or more silver halide emulsions having a hard photographic property (i.e., high contrast) even though the emulsions are desensitized by the addition of a rhodium salt or an organic desensitizing agent.

The third object of the present invention is to provide a silver halide photographic material in which fluctuation of the photographic property is small over time under natural storage conditions.

The fourth object of the present invention is to provide a silver halide photographic material which can give a hard gradation in a system containing a hydrazine compound.

The fifth object of the present invention is to provide a silver halide photographic material for daylight use, which has a low sensitive and high contrast photographic property which hardly fluctuates over time.

The sixth object of the present invention is to provide a low sensitive and high contrast silver halide photographic material which is free from development unevenness in the development process.

The seventh object of the present invention is to provide a method of stably preparing a fine silver halide grain emulsion having a low sensitivity, high contrast and stable photographic property.

The eighth object of the present invention is to provide a method of stably preparing a fine silver halide grain emulsion having a low sensitive, high contrast and stable photographic property, in which the grain size and the grain form do not fluctuate during the procedure.

The ninth object of the present invention is to provide a method of stably preparing a silver halide emulsion in which the chemical ripening of the grains formed is not extremely inhibited and the adsorption of sensitizing dye to the grains is not retarded.

The tenth object of the present invention is to provide a photographic light-sensitive material having a stable photographic property with no development unevenness.

The above-mentioned objects of the present invention can be attained by a silver halide photographic material having one or more silver halide photographic emulsions comprising cubic silver halide grains which have a mean grain size of 0.15μ or less and contain 99 mol % or more silver chloride.

DETAILED DESCRIPTION OF THE INVENTION

The mean grain size of the silver halide grains for use in the present invention is 0.15μ or less and is especially preferably 0.13μ or less. Most preferably, the mean grains size is from 0.05μ to 0.11μ. The grain size distribution is not specifically limitative but is preferably in the form of a monodispersion. "Monodispersion" herein means that at least 95% by weight or by number of the grains in the emulsion have a grain size falling within the range of the mean grain size ±40%.

The silver halide grains may have a uniform phase in the inside and the surface part thereof or may have different phases between the two parts. The halogen composition is preferably silver chloride or silver chlorobromide (having Br in an amount of 1 mol % or less).

It is extremely difficult to prepare stable cubic silver chlorobromide or silver chloride grains having a mean grain size of 0.15μ or less and containing 99 mol % or more silver chloride.

In the method of preparing fine silver halide grains having a mean grain size of 0.15μ or less and containing 99 mol % or more silver chloride of the present invention, it is fundamental in the formation of such fine grains to stabilize the nuclei grains formed in the initial stage of the grain formation or in the nucleus formation at the beginning of the addition of the raw material components and to form a large number of the nuclei grains. The larger the number of the stable nuclei, the finer the grain size of the final grains since the silver halides to be added later after the formation of the nuclei grains can be deposited over the nuclei grains.

For formation of stable nuclei grains, the physical ripening during the grain formation is to be minimized, or that is, it is important that the nuclei formed are controlled so as not to be re-dissolved.

Accordingly, the temperature for grain formation is better to be as low as possible, and is preferably 45° C. or lower. The potential (with reference electrode being a saturated calomel electrode) during the period of from just after the addition of raw material solutions to just before the desalting step is preferably within the range of from +80 mV to +600 mV, and in particular, it is preferably within the range of from +250 mV to +600 mV during the nucleus formation, i.e., the period of four minutes just after initiation of mixing of the raw material solutions.

The binder concentration is important for stabilizing the nuclei grains formed, and this is preferably within the range of from 0.2 to 4 wt %, more preferably from 0.5 to 3 wt %.

In order to form a large number of nuclei, it is important to add the raw material solutions (i.e., a silver nitrate aqueous solution and a halide aqueous solution) of high concentrations in a short period of time. For the purpose, concentrations of the silver nitrate aqueous solution and the halide aqueous solution are generally not less than 20 wt % and not less than 10 wt %, respectively. Further, the addition time is preferably 30 minutes or less, more preferably 20 minutes or less, and most preferably 15 minutes or less.

The stirring can be conducted by any desired means, which may preferably attain uniform stirring with high stirring efficiency.

Any and every method, which includes a single jet method, double jet method or combination thereof as well as a controlled double jet method, can be applied to the formation of the silver halide grains for use in the present invention.

It is preferred to add a tetrazaindene compound before, during or after the grain formation but before the desalting step set forth below, so as to stabilize the nuclei, to inhibit the grain growth and to inhibit the physical ripening of the grains formed. Preferably, this compound is added immediately after the grain formation. The amount of the compound to be added is from 0.1 to 10 g, preferably from 0.2 to 8 g, per mol of Ag.

The pH value during the grain formation is preferably 2.0 or more, especially 4.0 or more, so that the grains formed may adsorb the tetrazaindene compound.

In general, after the formation of the silver halide grains, unnecessary salts are removed from the resulting silver halide emulsion. For this, a flocculating agent capable of interacting with gelatin to form flocs is added and then the pH is optimized so that the silver halide grains and gelatin are flocculated and the resulting supernatant liquid is removed. Afterwards, fresh water is added and the grains and gelatin are washed therewith. The flocculation and washing step (or desalting step) is repeated twice or three times.

In the case of silver halide grains having a mean grain size of 0.15μ or less and containing 99 mol % or more silver chloride, the grains are physically ripened too much in the desalting step so that the grain size is enlarged or the grains are deformed. Accordingly, not only are the grains unstable during manufacture but also necessary photographic characteristics can not be obtained.

In particular, when the pH value during the flocculation and washing step is less than 3.1, the fluctuation of the grain size and grain form of the silver halide grains is great. However, if the pH value is 3.1 or more, the fluctuation is small. In addition, when a tetrazaindene compound is added before the flocculation and washing step, the value may be smaller. That is to say, when the pH value is high in the desalting step and a tetrazaindene compound is added, not only does the grain size not fluctuate but also the grain form (cubic form) may be kept as it is.

The above phenomenon is unknown up to the present, and this is more remarkable in silver halide grains having a mean grain size of 0.15μ or less and containing 99 mol % or more silver chloride. The reason is believed because the solubility of the grains is low as the grain size thereof is fine, the desorption or absorption power of the tetrazaindene compound and gelatin to the grains is weakened and the physical ripening of the grains is progressed. However, the detailed reason is not clear at present, which will have to be clarified in the future.

The pH value in the desalting step is preferably within the range of from 3.2 to 4.8, and more preferably from 3.4 to 4.8.

The gelatin to be used for preparing the silver halide emulsion of the present invention may be anyone of a lime-processed gelatin, an acid-processed gelatin, a phthalated gelatin or a combination thereof.

After grain formation or physical ripening, soluble salts are removed from the resulting emulsion (desalting step). For this removal, it is preferable to utilize a flocculation method using an anionic surfactant, an anionic polymer (e.g., polystyrenesulfonic acid), or a gelatin derivative (e.g., acylated gelatins, carbamoylated gelatins, etc.).

Tetrazaindene compounds which can preferably be used in the present invention are those as represented by the following formula (I)

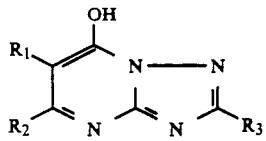

(I)

wherein $R_1$, $R_2$ and $R_3$ each represents a hydrogen atom, an alkyl group, an amino group, a derivative of an alkyl group, a derivative of an amino group, a halogen atom, an aryl group, a derivative of an aryl group or —CONH—$R_4$, where $R_4$ is a hydrogen atom, an alkyl group, an amino group, a derivative of an alkyl group, a derivative of an amino group, a halogen atom, an aryl group or a derivative of an aryl group.

Specific examples of the tetrazaindene compounds for use in the present invention are mentioned below.

I-1

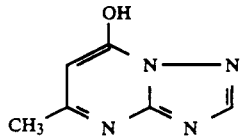

I-2

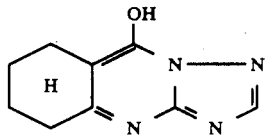

I-3

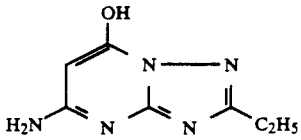

I-4

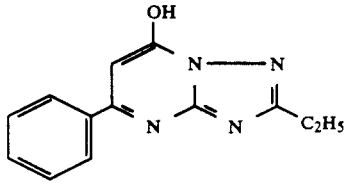

I-5

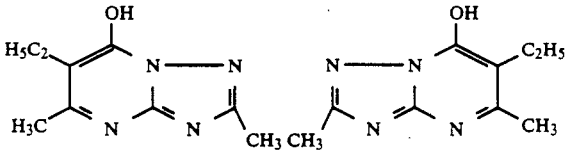

I-6

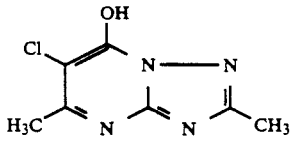

-continued

I-7

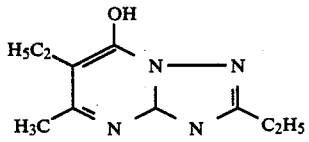

I-8

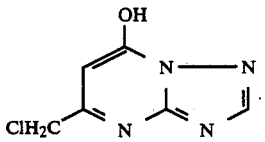

I-9

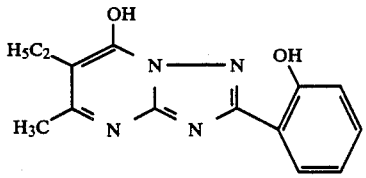

I-10

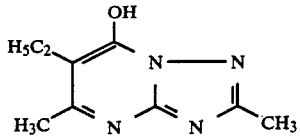

I-11

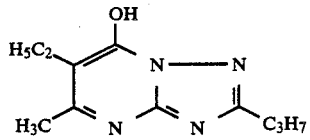

I-12

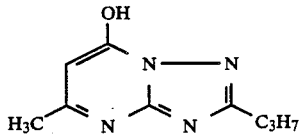

I-13

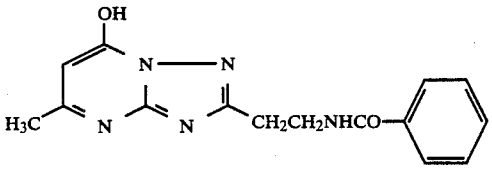

I-14

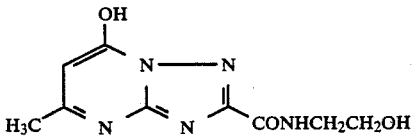

I-15

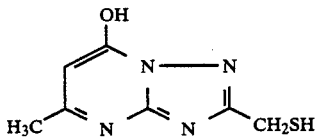

I-16

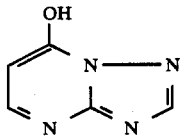

The characteristic feature of the tetrazaindene compound is that the compound adsorbs to silver halide grains so as to suppress physical ripening of the grains and a part, not the whole, of the compound adsorbed to the grains is desorbed from the grains and is taken out of the system when the pH of the system is lowered in the flocculation and washing step. This means that the compounds substantially do neither inhibit the chemical ripening of the silver halide grains by a chemical sensitizer nor retard the adsorption of a sensitizing dye to the silver halide grains. That is, the addition of the tetrazaindene compound is an important technique for forming silver halide grains having a fine grain size of 0.15μ or less with no substantial influence on the successive steps.

The silver halide photographic material containing one or more silver halide emulsions having a mean grain size of 0.15μ and a silver chloride content of 99 mol % or more is often made uneven when developed (development unevenness). In addition, if the material is used as a printing material, there is another problem in that the reducing speed is extremely high when the material is reduced with a reducer such as cerium sulfate, Farmer's reducer, EDTA-Fe, etc.

In order to overcome the above problem, the material may be processed in the presence of a compound which can adsorb to the surface of the silver halide crystals by formation of a bond between the sulfur atom in the compound and the silver ion, such as mercaptotetrazoles, mercaptotriazoles, mercaptothiadiazoles, benzothiazole-2-thiones, etc., or a compound which can adsorb to the surface of the silver halide crystals by formation of a bond between the nitrogen atom in the compound and the silver ion, such as benzotriazoles, benzimidazoles, hydroxytetrazaindenes, purine, etc., and accordingly a good result can be attained.

Among the above-mentioned sulfur-containing compounds which can preferably be used in the present invention, mercapto group-containing compounds are typically those as represented by the following formula (II)

$$Z_1\text{—SH} \qquad \text{(II)}$$

wherein $Z_1$ represents an aliphatic group (e.g., a substituted alkyl group such as a carboxyethyl group, a hydroxyethyl group, a diethylaminoethyl group, etc.), an aromatic group (e.g., a phenyl group, etc.) or a heterocyclic group (preferably having a 5-membered or 6-membered ring). The total carbon number in the aliphatic group or the aromatic group is preferably 18 or less. Among the groups is especially preferred a heterocyclic group having one or more nitrogen atoms in the ring, in which the total carbon number is preferably 30 or less, and more preferably 18 or less.

The heterocyclic group for $Z_1$ may further be condensed, and for example, this is preferably a residue of an imidazole, a triazole, a tetrazole, a thiazole, an oxazole, a selenazole, a benzimidazole, a benzoxazole, a benzothiazole, a thiadiazole, an oxadiazole, a benzoselenazole, a pyrazole, a pyrimidine, a triazine, a pyridine, a naphthothiazole, a naphthoimidazole, a naphthoxazole, an azabenzimidazole, a purine, an azaindene (e.g., a triazaindene, a tetrazaindene, a pentazaindene, etc.), etc.

The heterocyclic residues and condensed rings can be substituted by proper substituent(s).

Examples of the substituents include an alkyl group (e.g., a methyl group, an ethyl group, a hydroxyethyl group, a trifluoromethyl group, a sulfopropyl group, a di-propylaminoethyl group, an adamantyl group, etc.), an alkenyl group (e.g., an allyl group, etc.), an aralkyl group (e.g., a benzyl group, a p-chlorophenethyl group, etc.), an aryl group (e.g., a phenyl group, a naphthyl group, a p-carboxyphenyl group, a 3,5-dicarboxyphenyl group, a m-sulfophenyl group, a p-acetamidophenyl group, a 3-capramidophenyl group, a p-sulfamoylphenyl group, a m-hydroxyphenyl group, a p-nitrophenyl group, a 3,5-dichlorophenyl group, a 2-methoxyphenyl group, etc.), a heterocyclic group (e.g., a pyridine, etc.), a halogen atom (e.g., a chlorine atom, a bromine atom, etc.), a mercapto group, a cyano group, a carboxy group, a sulfo group, a hydroxyl group, a carbamoyl group, a sulfamoyl group, an amino group, a nitro group, an alkoxy group (e.g., a methoxy group, an ethoxy group, etc.), an aryloxy group (e.g., a phenoxy group, etc.), an acyl group (e.g., an acetyl group, etc.), an acylamino group (e.g., an acetylamino group, a capramido group, a methylsulfonylamino group, etc.), a substituted amino group (e.g., a diethylamino group, a hydroxyamino group, etc.), an alkyl- or arylthio group (e.g., a methylthio group, a carboxyethylthio group, a sulfobutylthio group, etc.), an alkoxycarbonyl group (e.g., a methoxycarbonyl group, etc.), an aryloxycarbonyl group (e.g., a phenoxycarbonyl group, etc.), etc.

Disulfide compounds ($Z_1$—S—S—$Z_1$) which can be cleaved into the form of formula (II) in an emulsion with ease can also be used.

Among the sulfur-containing inhibitors, thioketone group-containing compounds are typically those represented by the following formula (III)

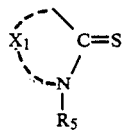

(III)

wherein $R_5$ represents an alkyl group, an aralkyl group, an alkenyl group or an aryl group; and $X_1$ represents an atomic group necessary for forming a 5-membered or 6-membered ring which may be condensed to form a condensed ring.

Examples of the hetero ring to be formed by $X_1$ include a thiazoline, a thiazolidine, a selenazoline, an oxazoline, an oxazolidine, an imidazoline, an imidazolidine, a thiadiazoline, an oxadiazoline, a triazoline, a tetrazoline, a pyrimidine, etc. Further, the hetero ring may be condensed with carbon ring(s) and/or hetero ring(s), and examples of the condensed ring includes a benzothiazoline, a naphthothiazoline, a tetrahydrobenzothiazoline, a benzimidazoline, a benzoxazoline, etc.

The hetero rings may be substituted by the substituent(s) which are mentioned for the compounds of formula (II).

$R_5$ represents an alkyl group (e.g., a methyl group, a propyl group, a sulfopropyl group, a hydroxyethyl group, etc.), an alkenyl group (e.g., an allyl group, etc.), an aralkyl group (e.g., a benzyl group, etc.), an aryl group (e.g., a phenyl group, a p-tolyl group, an o-chlorophenyl group, etc.) or a heterocyclic group (e.g., a pyridyl group, etc.).

Specific examples of the compounds of formula (II) are mentioned below.

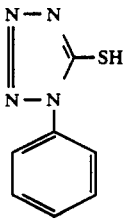

II-1

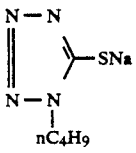

II-2

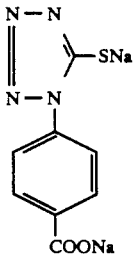

II-3

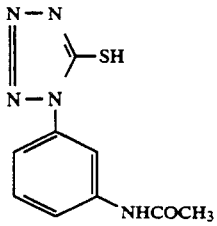

II-4

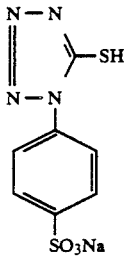

II-5

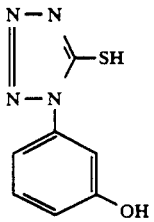

II-6

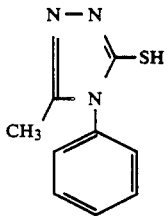

II-7

-continued
II-8
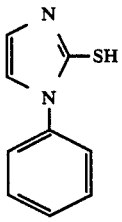
II-9
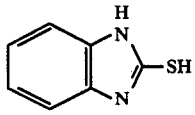
II-10
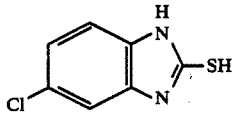
II-11
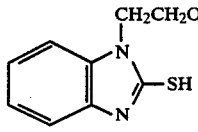
II-12
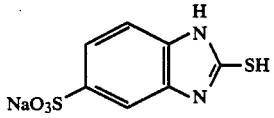
II-13
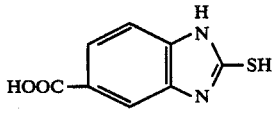
II-14
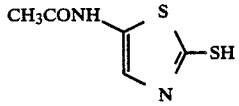
II-15
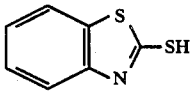
II-16
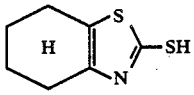
II-17
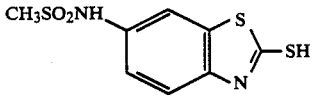
II-18
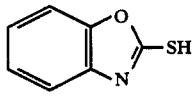
II-19
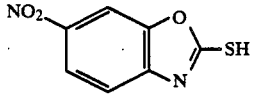
-continued
II-20
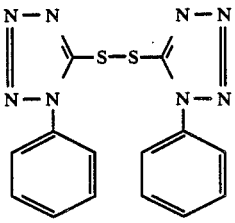
II-21
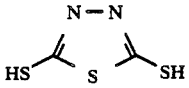
II-22
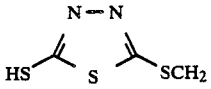
II-23
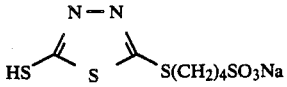
II-24
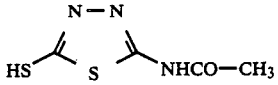
II-25
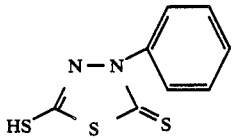
II-26
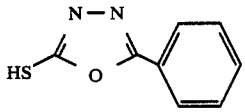
II-27
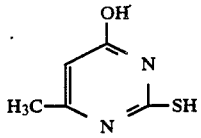
II-28
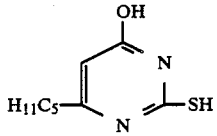
II-29
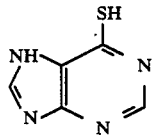
II-30
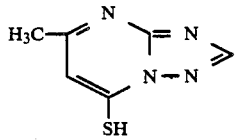

-continued

II-31

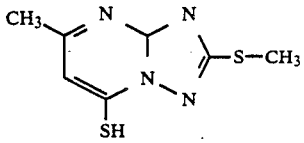

II-32

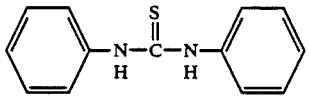

II-33

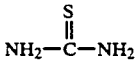

II-34

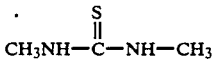

Specific examples of the compounds of formula (III) are mentioned below.

III-1

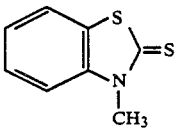

III-2

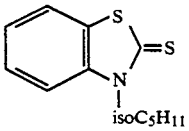

III-3

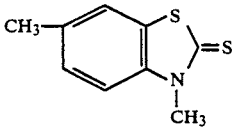

III-4

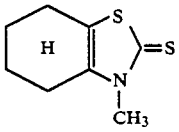

III-5

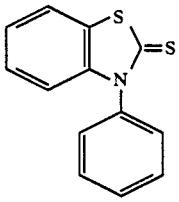

III-6

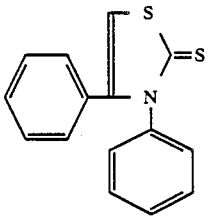

-continued

III-7

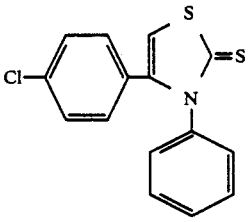

III-8

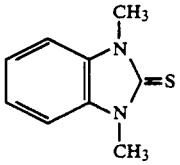

III-9

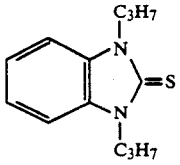

III-10

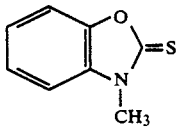

III-11

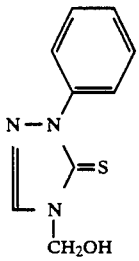

III-12

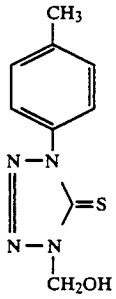

III-13

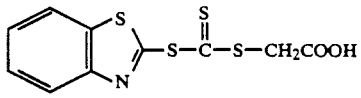

These compounds can be produced as described by E. J. Birr, *Stabilization of Photographic Silver Halide Emulsions* (by Focal Press, 1974), C. G. Barlow et al., *Rer. Prog. Appl. Chem.*, Vol. 59, page 159 (1974), *Research Disclosure*, No. 17643 (1978), Japanese Patent Publication Nos. 34169/73, 18008/72 and 23368/74, *Magazine of Science*, 74, 1365–1369 (1954), Beilsteln XII, 394, IV, No. 121, etc.

Specific examples of benzotriazoles, benzimidazoles, hydroxytetrazaindenes and pyrines are mentioned below, which, however, are not whatsoever limitative.

N-1

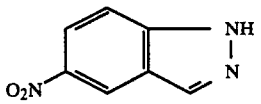

N-2

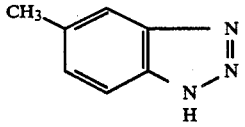

N-3

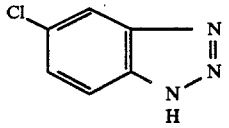

N-4

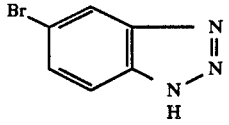

N-5

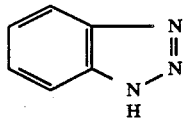

N-6

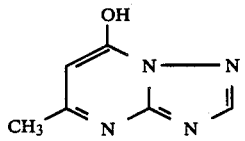

N-7

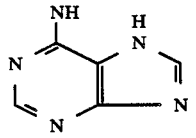

The compounds of the above-mentioned formulae (II) and (III) and the compounds of IV-1 to IV-7 are used in the preparation of concentrated stock emulsions, especially after the post-ripening thereof. In particular, it is preferred to add the compounds in the preparation of a diluted coating emulsion.

The amount of the compound to be used is within the range of from 0.1 mg/m$^2$ to 100 mg/m$^2$, and preferably from 1 mg/m$^2$ to 50 mg/m$^2$.

A rhodium salt can be added to the silver halide emulsion of the present invention in the grain formation step or the physical ripening step.

The rhodium salt to be used for this purpose may be anyone which can be incorporated into the silver halide grains, such as rhodium monochloride, rhodium dichloride, rhodium trichloride, ammonium hexachlororhodate, etc., but water-soluble trivalent rhodium-halogeno complexes, such as hexachloro-rhodic(III) acid and salts thereof (e.g., ammonium salt, sodium salt, potassium salt, etc.), are preferred.

The amount of the rhodium salt to be used in the present invention is from $1\times10^{-8}$ mol to $5\times10^{-4}$ mol, preferably from $10^{-5}$ mol to $5\times10^{-4}$ mol, more preferably from $5\times10^{-5}$ mol to $5\times10^{-4}$ mol, per mol of silver.

If the amount exceeds $5\times10^{-4}$ mol, the fine line-clearing capacity is worsened, as mentioned below. In particular, when a large amount of a rhodium salt is added to a hydrazine-containing photographic material, there is a defect in that the lowering of the sensitivity is too great.

On the contrary, if the amount of the rhodium salt to be added is less than $10^{-5}$ mol, there is a defect in that the trace of the image edge is too remarkable. Further, in the case of a hydrazine-containing photographic material, there is another defect in that the intended lowering of the sensitivity can not be attained.

In the present invention, a cadmium salt, a lead salt, a thallium salt and/or an iridium salt can also be used, together with the rhodium salt, in an amount of $10^{-8}$ to $10^{-6}$ mol per mol of silver.

The present invention is preferably applied to an ultra-contrast photographic material containing a hydrazine derivative.

The hydrazine derivative which can preferably be used in the present invention is represented by the following formula (V)

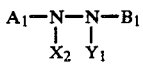

(V)

wherein $A_1$ represents an aliphatic group or an aromatic group; $B_1$ represents a formyl group, an acyl group, an alkyl- or aryl-sulfonyl group, an alkyl- or aryl-sulfinyl group, a carbamoyl group, an alkoxy- or aryloxy-carbonyl group, a sulfinamoyl group, an alkoxysulfonyl group, a thioacyl group, a thiocarbamoyl group, a sulfanyl group or a heterocyclic group; $X_2$ and $Y_1$ are both hydrogen atoms, or one of them is a hydrogen atom and the other represents a substituted or unsubstituted alkylsulfonyl group, a substituted or unsubstituted arylsulfonyl group or a substituted or unsubstituted acyl group; provided that $B_1$ and $Y_1$ and the adjacent nitrogen atom may form a hydrazone partial structure of

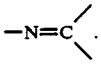

In formula (V), the aliphatic group for $A_1$ preferably has from 1 to 30 carbon atoms, and in particular a linear, branched or cyclic alkyl group having from 1 to 20 carbon atoms. The branched alkyl group may be cyclized so as to form a saturated hetero-ring containing one or more hetero atoms therein. The alkyl group may optionally have substituent(s) selected from an aryl group, an alkoxy group, a sulfoxy group, a sulfonamido group, a carbonamido group, etc.

For instance, there may be mentioned a t-butyl group, an n-octyl group, a t-octyl group, a cyclohexyl group, a pyrrolidyl group, an imidazolyl group, a tetrahydrofuryl group, a morpholino group as specific examples of said group.

In formula (V), the aromatic group for $A_1$ is a monocyclic or di-cyclic aryl group or an unsaturated heterocyclic group The unsaturated heterocyclic group may be condensed with a mono-cyclic or di-cyclic aryl group to form a heteroaryl group.

For example, there may be mentioned a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. In particular, a benzene ring-containing group is preferred among them.

$A_1$ is especially preferably an aryl group.

The aryl group or unsaturated heterocyclic group for $A_1$ may have substituent(s). Specific examples of the substituents for the group include a linear, branched or cyclic alkyl group (preferably having from 1 to 20 carbon atoms), an aralkyl group (preferably a monocyclic or dicyclic group in which the alkyl moiety has from 1 to 3 carbon atoms), an alkoxy group (preferably having from 1 to 20 carbon atoms), a substituted amino group (preferably an amino group substituted by one or more alkyl groups having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), etc.

In formula (V), $A_1$ may contain a ballast group therein which is commonly used in photographic passive additives such as couplers, etc. The ballast group is a group which is relatively photographically inactive and which has 8 or more carbon atoms, and for example, can be selected from an alkyl group, an alkoxy group, a phenyl group, an alkylphenyl group, a phenoxy group, an alkylphenoxy group, etc.

In formula (V), $A_1$ may also contain a group therein which can strengthen the absorbency of the compound to the surface of the silver halide grains. As examples of such groups may be mentioned the thiourea groups, the heterocyclic thioamido groups, the mercapto-heterocyclic groups, the triazole groups and others described in U.S. Pat. Nos. 4,385,108 and 4,459,347, Japanese Patent Application (OPI) Nos. 195233/84, 200231/84, 201045/84, 201046/84, 201047/84, 201048/84 and 201049/84, and Japanese Patent Application Nos. 36788/84, 11459/85, 19739/85, etc.

$B_1$ represents a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamoyl group, etc.), an alkylsulfonyl group (e.g., a methanesulfonyl group, a 2-chloroethanesulfonyl group, etc.), an arylsulfonyl group (e.g., a benzenesulfonyl group, etc.), an alkylsulfinyl group (e.g., a methanesulfinyl group, etc.), an arylsulfinyl group (e.g., a benzenesulfinyl group, etc.), a carbamoyl group (e.g., a methylcarbamoyl group, a phenylcarbamoyl group, etc.), a sulfamoyl group (e.g., a dimethylsulfamoyl group, etc.), an alkoxycarbonyl group (e.g., a methoxycarbonyl group, a methoxyethoxycarbonyl group, etc.), an aryloxycarbonyl group (e.g., a phenoxycarbonyl group, etc.), a sulfinamoyl group (e.g., a methylsulfinamoyl group, etc.), an alkoxysulfonyl group (e.g., a methoxysulfonyl group, an ethoxysulfonyl group, etc.), a thioacyl group (e.g., a methylthiocarbonyl group, etc.), a thiocarbamoyl group (e.g., a methylthiocarbamoyl group, etc.), or a heterocyclic group (e.g., a pyridine ring, etc.).

$B_1$ is especially preferably a formyl group or an acyl group.

In formula (V), $B_1$ and $Y_1$ may form, together with the adjacent nitrogen atom, a hydrazone partial structure of:

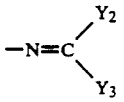

wherein $Y_2$ represents an alkyl group, an aryl group or a heterocyclic group; and $Y_3$ represents a hydrogen atom, an alkyl group, an aryl group or a heterocyclic group.

$X_2$ and $Y_1$ each represents a hydrogen atom, an alkylsulfonyl or arylsulfonyl group having up to 20 carbon atoms (preferably a phenylsulfonyl group, or a phenylsulfonyl group substituted so that the total of the Hammett's substituent constants is −0.5 or more), or an acyl group having up to 20 carbon atoms (preferably a benzoyl group, a benzoyl group substituted so that the total of the Hammett's substituent constants is −0.5 or more), or a linear, branched or cyclic, unsubstituted or substituted aliphatic acyl group, the substituents for the group being selected, for example, from a halogen atom, an ether group, a sulfonamido group, a carbonamido group, a hydroxyl group, a carboxyl group and a sulfonic acid group. $X_2$ and $Y_1$ are most preferably hydrogen atoms.

Specific examples of the compounds of formula (V) are mentioned below, which, however, are not intended to limit the scope of the present invention.

V-1

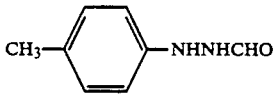

V-2

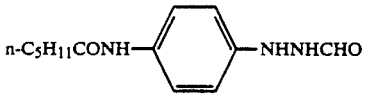

V-3

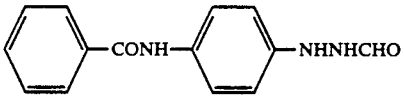

V-4

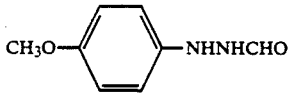

-continued
V-5
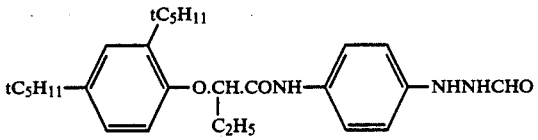
V-6
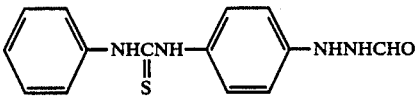
V-7
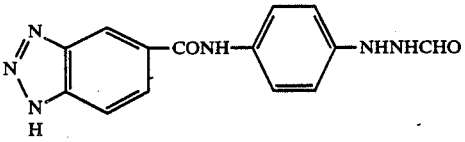
V-8
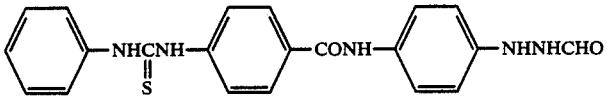
V-9
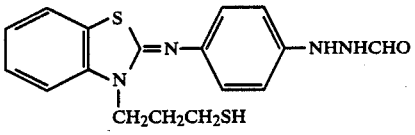
V-10
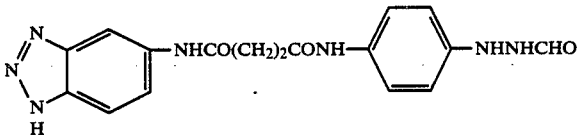
V-11
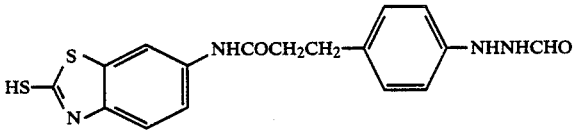
V-12
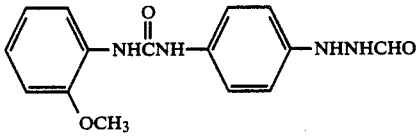
V-13
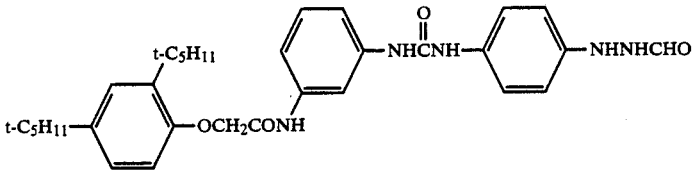
V-14
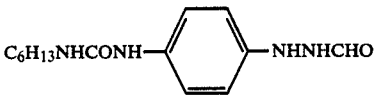

-continued
V-15
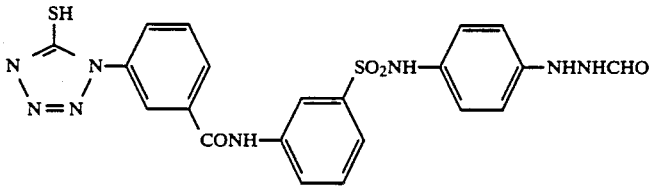
V-16
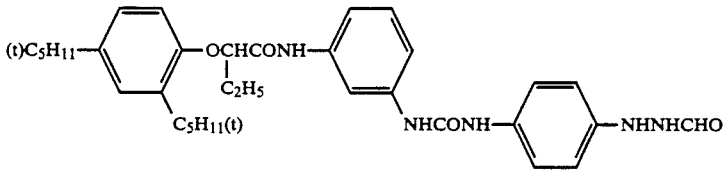
V-17
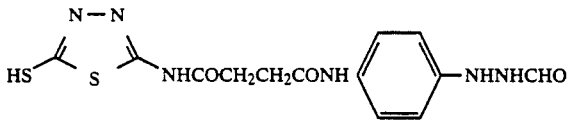
V-18
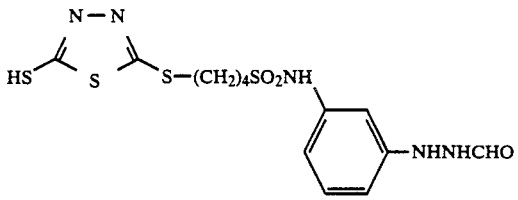
V-19
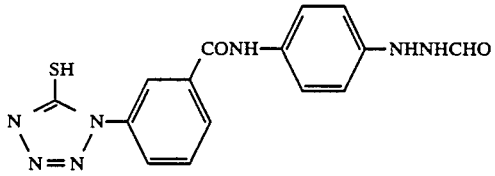
V-20
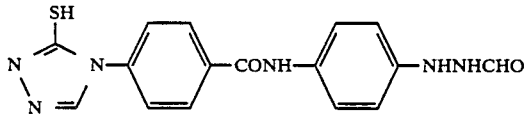
V-21
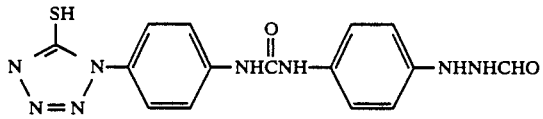
V-22
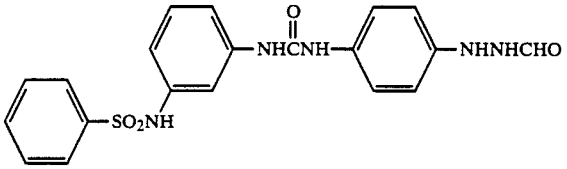
V-23
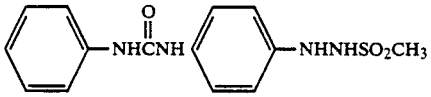
V-24
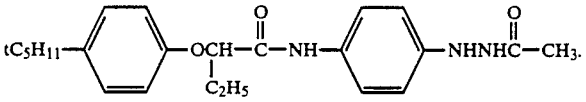

-continued

V-25

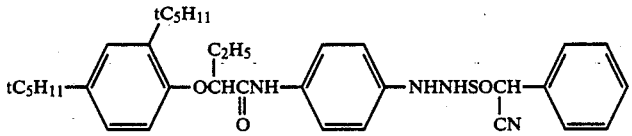

V-26

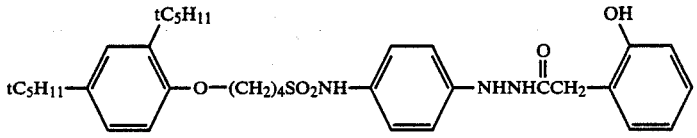

V-27

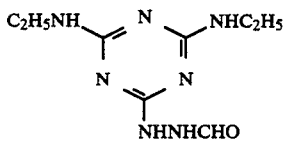

V-28

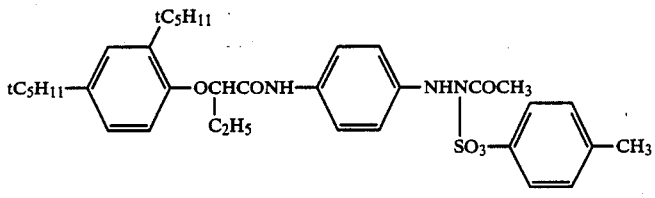

V-29

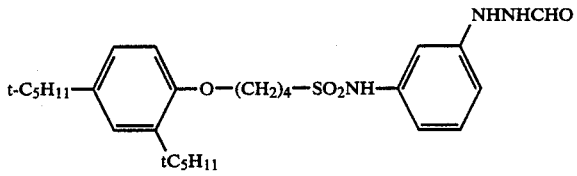

V-30

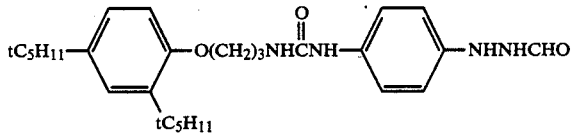

V-31

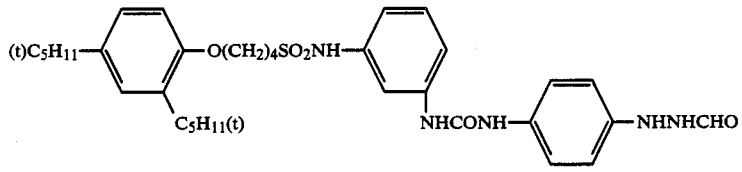

As the hydrazine derivatives, those described in Research Disclosure, Item 23516 (November, 1983, page 346) and the references referred to therein as well as U.S. Pat. Nos. 4,080,207, 4,269,929, 4,276,364, 4,278,748, 4,385,108, 4,459,347, 4,560,638, 4,478,928, British Patent No. 2,011,391B and Japanese Patent Application (OPI) No. 179734/85 can also be used in the present invention, in addition to the abovementioned examples.

The compound of formula (V) is preferably added to the photographic material in an amount of from $1\times10^{-6}$ to $5\times10^{-2}$ mol, especially from $1\times10^{-5}$ to $2\times10^{-2}$ mol per mol of the silver halide.

In the present invention, it is preferred to use a compound having the following general formula (VI) or (VII) together with the hydrazine derivative of formula (V), whereby the high contrast is enhanced and the lowering of the gradation caused by the lowering of the sensitivity can be prevented.

The general formula (VI) is shown below:

$$Y_4\text{-}(X_3)\text{-}(_n)\text{-}A_2\text{-}B_2)_m \qquad \text{(VI)}$$

wherein $Y_4$ represents a group capable of adsorbing to silver halide grains; $X_3$ represents a divalent linking group of an atom or an atomic group comprising a hydrogen atom, a carbon atom, a nitrogen atom, an oxygen atom and/or a sulfur atom; $A_2$ represents a divalent linking group; $B_2$ represents an amino group, an ammonium group or a nitrogen-containing heterocyclic group, in which the amino group may optionally be substituted; m represents 1, 2 or 3; and n represents 0 or 1.

As the group capable of adsorbing to silver halide grains for $Y_4$, nitrogen-containing heterocyclic compounds can be mentioned.

When $Y_4$ represents a nitrogen-containing heterocyclic compound residue, the compounds of formula (VI)

are represented by the following general formula (VI-a)

(VI-a)

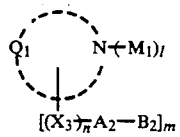

wherein represents 0 or 1; $[(X_3)_n\text{-}A_2\text{-}B_2]_m$ has the same meaning as that in the above-mentioned formula (VI); and $Q_1$ represents an atomic group necessary for forming a 5-membered or 6-membered hetero ring composed of at least one of a carbon atom, a nitrogen atom, an oxygen atom and a sulfur atom, and the hetero ring may optionally be condensed with a carbon-aromatic ring or a hetero-aromatic ring.

Examples of the hetero ring to be formed by the atomic group $Q_1$ include substituted or unsubstituted indazoles, benzimidazoles, benzotriazoles, benzoxazoles, benzothiazoles, imidazoles, thiazoles, oxazoles, triazoles, tetrazoles, azaindenes, pyrazoles, indoles, triazines, pyrimidines, pyridines, quinolines, etc.

In formula (VI-a), $M_1$ represents a hydrogen atom, an alkali metal atom (e.g., a sodium atom, a potassium atom, etc.), an ammonium group (e.g., a trimethylammonium group, a dimethylbenzylammonium group, etc.), or a group capable of becoming a hydrogen atom or an alkali metal atom under an alkaline condition (e.g., an acetyl group, a cyanoethyl group, a methanesulfonylethyl group, etc.).

The hetero rings may optionally be substituted by substituent(s) selected from a nitro group, a halogen atom (e.g., a chlorine atom, a bromine atom, etc.), a mercapto group, a cyano group, a substituted or unsubstituted alkyl group (e.g., a methyl group, an ethyl group, a propyl group, a t-butyl group, a cyanoethyl group, a methoxyethyl group, a methylthioethyl group, etc.), a substituted or unsubstituted aryl group (e.g., a phenyl group, a 4-methanesulfonamidophenyl group, a 4-methylphenyl group, a 3,4-dichlorophenyl group, a naphthyl group, etc.), a substituted or unsubstituted alkenyl group (e.g., an allyl group, etc.), a substituted or unsubstituted aralkyl group (e.g., a benzyl group, a 4-methylbenzy group, a phenethyl group, etc.), a substituted or unsubstituted alkoxy group (e.g., a methoxy group, an ethoxy group, etc.), a substituted or unsubstituted aryloxy group (e.g., a phenoxy group, a 4-methoxyphenoxy group, etc.), a substituted or unsubstituted alkylthio group (e.g., a methylthio group, an ethylthio group, a methxoyethylthio group), a substituted or unsubstituted arylthio group (e.g., a phenylthio group, etc.), a substituted or unsubstituted sulfonyl group (e.g., a methanesulfonyl group, an ethanesulfonyl group, a p-toluenesulfonyl group, etc.), a substituted or unsubstituted carbamoyl group (e.g., an unsubstituted carbamoyl group, a methylcarbamoyl group, a phenylcarbamoyl group, etc.), a substituted or unsubstituted sulfamoyl group (e.g., an unsubstituted sulfamoyl group, a methylsulfamoyl group, a phenylsulfamoyl group, etc.), a substituted or unsubstituted carbonamido group (e.g., an acetamido group, a benzamido group, etc.), a substituted or unsubstituted sulfonamido group (e.g., a methanesulfonamido group, a benzenesulfonamido group, a p-toluenesulfonamido group, etc.), a substituted or unsubstituted acyloxy group (e.g., an acetyloxy group, a benzoyloxy group, etc.), a substituted or unsubstituted sulfonyloxy group (e.g., a methanesulfonyloxy group, etc.), a substituted or unsubstituted ureido group (e.g., an unsubstituted ureido group, a methylureido group, an ethylureido group, a phenylureido group, etc.), a substituted or unsubstituted thioureido group (e.g., an unsubstituted thioureido group, a methylthioureido group, etc.), a substituted or unsubstituted acyl group (e.g., an acetyl group, a benzoyl group, etc.), a substituted or unsubstituted heterocyclic group (e.g., a 1-morpholino group, a 1-piperidino group, a 2-pyridyl group, a 4-pyridyl group, a 2-thienyl group, a 1-pyrazolyl group, a 1-imidazolyl group, a 2-tetrahydrofuryl group, a tetrahydrothienyl group, etc.), a substituted or unsubstituted oxycarbonyl group (e.g., a methoxycarbonyl group, a phenoxycarbonyl group, etc.), a substituted or unsubstituted oxycarbonylamino group (e.g., a methoxycarbonylamino group, a phenoxycarbonylamino group, a 2-ethylhexyloxycarbonylamino group, etc.), a substituted or unsubstituted amino group (e.g., an unsubstituted amino group, a dimethylamino group, a methoxyethylamino group, an anilino group, etc.), a substituted or unsubstituted carboxylic acid group or a salt thereof, a substituted or unsubstituted sulfonic acid group or a salt thereof, a hydroxyl group, etc.

Examples of the divalent linking group for $X_3$ include —S—, —O—,

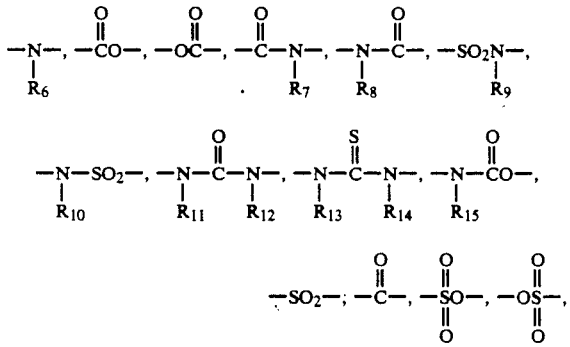

etc.

The linking group may be bonded to the group $Q_1$, optionally via a linear or branched alkylene group (e.g., a methylene group, an ethylene group, a propylene group, a butylene group, a hexylene group, a 1-methylethylene group, etc.). $R_6$, $R_7$, $R_8$, $R_9$, $R_{10}$, $R_{11}$, $R_{12}$, $R_{13}$, $R_{14}$ and $R_{15}$ each represents a hydrogen atom, a substituted or unsubstituted alkyl group (e.g., a methyl group, an ethyl group, a propyl group, an n-butyl group, etc.), a substituted or unsubstituted aryl group (e.g., a phenyl group, a 2-methylphenyl group, etc.), a substituted or unsubstituted alkenyl group (e.g., a propenyl group, a 1-methylvinyl group, etc.), or a substituted or unsubstituted aralkyl group (e.g., a benzyl group, a phenethyl group, etc.).

$A_2$ in formula (VI) or (VI-a) represents a divalent linking group, which, for example, includes a linear or branched alkylene group (e.g., a methylene group, an ethylene group, a propylene group, a butylene group, a hexylene group, 1-methylethylene group, etc.), a linear or branched alkenylene group (e.g., a vinylene group, a 1-methylvinylene group, etc.), a linear or branched aralkylene group (e.g., a benzylidene group, etc.), or an arylene group (e.g., a phenylene group, a naphthylene group, etc.), etc. The above-mentioned group for $A_2$ may further be substituted in any combination of X and $A_2$.

The substituted or unsubstituted amino group for $B_2$ is represented by the following formula (VI-b):

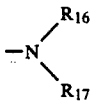

(VI-b)

wherein $R_{16}$ and $R_{17}$ may be the same or different and each represents a hydrogen atom, a substituted or unsubstituted alkyl, alkenyl or aralkyl group having from 1 to 30 carbon atoms, and the group may be linear (for example, in the form of a methyl group, an ethyl group, an n-propyl group, an n-butyl group, an n-octyl group, an allyl group, a 3-butenyl group, a benzyl group, a 1-naphthylmethyl group, etc.), branched (for example, in the form of an isopropyl group, a t-octyl group, etc.), or cyclic (for example, in the form of a cyclohexyl group, etc.).

Alternatively, $R_{16}$ and $R_{17}$ may be linked together to form a ring, which can contain one or more hetero atoms (e.g., oxygen atom, sulfur atom, nitrogen atom, etc.) to form a saturated hetero-ring. Examples of the heterocyclic group include a pyrrolidyl group, a piperidyl group, a morpholino group, etc. The groups for $R_{16}$ and $R_{17}$ may be substituted, and examples of the substituents for the groups include a carboxyl group, a sulfo group, a cyano group, a halogen atom (e.g., a fluorine atom, a chlorine atom, a bromine atom, etc.), a hydroxyl group, an alkoxycarbonyl group having up to 20 carbon atoms (e.g., a methoxycarbonyl group, an ethoxycarbonyl group, a phenoxycarbonyl group, a benzyloxycarbonyl group, etc.), an alkoxy group having up to 20 carbon atoms (e.g., a methoxy group, an ethoxy group, a benzyloxy group, a phenethyloxy group, etc.), a monocyclic aryloxy group having up to 20 carbon atoms (e.g., a phenoxy group, a p-tolyloxy group, etc.), an acyloxy group having up to 20 carbon atoms (e.g., an acetyloxy group, a propionyloxy group, etc.), an acyl group having up to 20 carbon atoms (e.g., an acetyl group, a propionyl group, a benzoyl group, a mesyl group, etc.), a carbamoyl group (e.g., a carbamoyl group, an N,N-dimethylcarbamoyl group, a morpholinocarbonyl group, a piperidinocarbonyl group, etc.), a sulfamoyl group (e.g., a sulfamoyl group, an N,N-dimethylsulfamoyl group, a morpholinosulfonyl group, a piperidinosulfonyl group, etc.), an acylamino group having up to 20 carbon atoms (e.g., an acetylamino group, a propionylamino group, a benzoylamino group, a mesylamino group, etc.), a sulfonamido group (e.g., an ethylsulfonamido group, a o-toluenesulfonamido group, etc.), a carbonamido group having up to 20 carbon atoms (e.g., a methylcarbonamido group, a phenylcarbonamido group, etc.), a ureido group having up to 20 carbon atoms (e.g., a methylureido group, a phenylureido group, etc.), an amino group, etc.

The ammonium group for $B_2$ is represented by the following formula (VI-c)

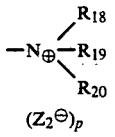

(VI-c)

wherein $R_{18}$, $R_{19}$ and $R_{20}$ have the same meanings as $R_{16}$ and $R_{17}$ in the above-mentioned formula (VI-b); and $Z_2^{\ominus}$ represents an anion, for example, including a halide ion (e.g., $Cl^{\ominus}$, $Br^{\ominus}$, $I^{\ominus}$, etc.), a sulfonato ion (e.g., a trifluoromethanesulfonato, a paratoluenesulfonato, a benzenesulfonato, a parachlorobenzenesulfonato, etc.), a sulfato ion (e.g., an ethylsulfato, a methylsulfato, etc.), a prchlorato, a tetrafluoroborato, etc.; and p represents 0 or 1, and when the compound forms an internal salt, p is 0.

The nitrogen-containing hetero-ring for $B_2$ is a 5-membered or 6-membered ring containing at least one nitrogen atom, and the ring may optionally have substituent(s), or may optionally be condensed with any other ring(s). Examples of the nitrogen-containing heterocyclic group include an imidazolyl group, a pyridyl group, a thiazolyl group, etc.

Among the compounds of formula (VI), those represented by the following formula (VI-m), (VI-n), (VI-o) or (VI-p) are preferred.

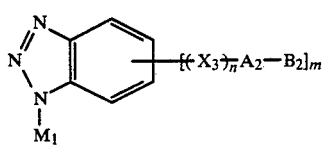

(VI-m)

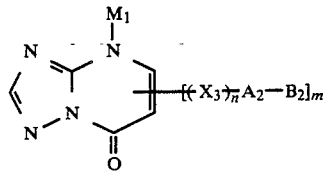

(VI-n)

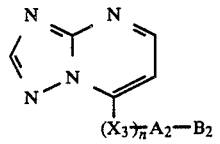

(VI-o)

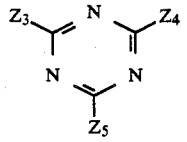

(VI-p)

In these formulae, $-(X_3)_n-A_2-B_2$, $M_1$ and m have the same meanings as those in the above-mentioned formula (VIa); $Z_3$, $Z_4$ and $Z_5$ have the same meanings as $-(X_3)_n-A_2-B_2$ in formula (VI-a) or these each represents a halogen atom, an alkoxy group having up to 20 carbon atoms (e.g., a methoxy group, etc.), a hydroxyl group, a hydroxyamino group, or a substituted or unsubstituted amino group, and the substituents for the group can be selected from those for $R_{16}$ and $R_{17}$ in the above-mentioned formula (VI-b); provided that at least one of $Z_3$, $Z_4$ and $Z_5$ must have the same meaning as $-(X_3)_n-A_2-B_2$.

These hetero rings may optionally be substituted by the substituent(s) as referred to for the hetero rings in formula (VI).
Examples of the compounds of formula (VI) are mentioned below, which, however, are not intended to limit the scope of the present invention.
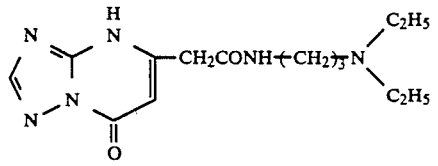
VI-1
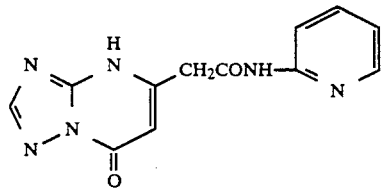
VI-2
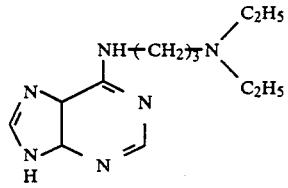
VI-3
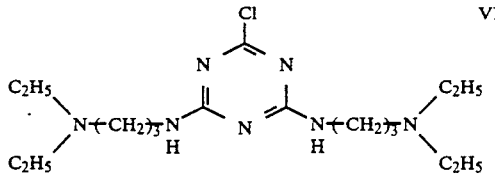
VI-4
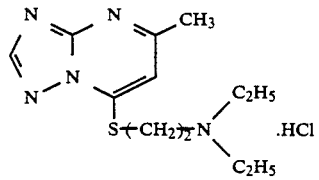
VI-5
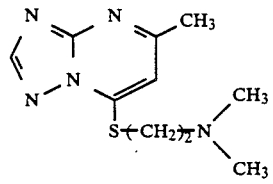
VI-6
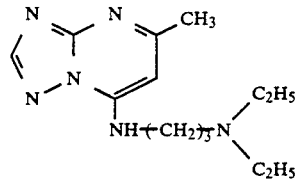
VI-7
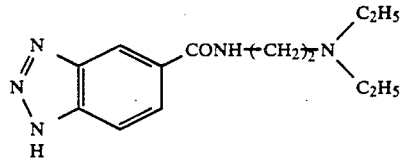
VI-8
-continued
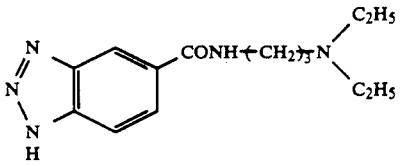
VI-9
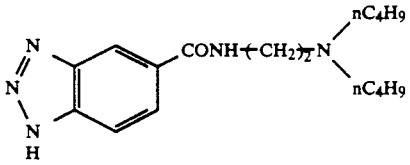
VI-10
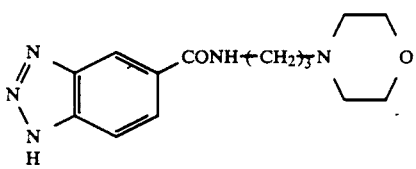
V-11
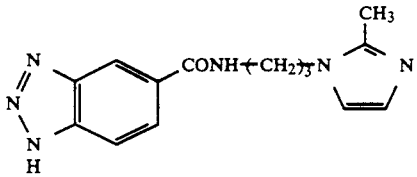
VI-12
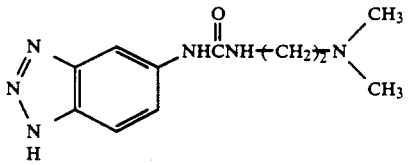
VI-13
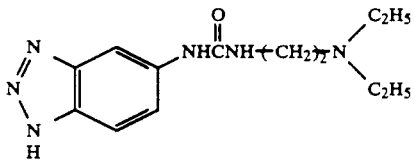
VI-14
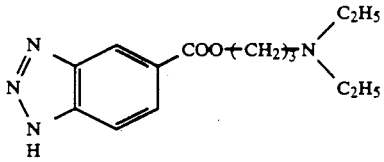
VI-15
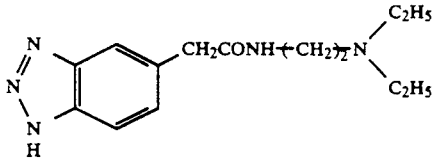
VI-16
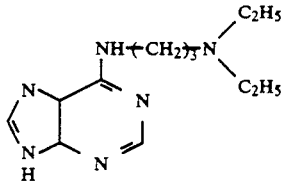
VI-17

-continued

VI-18

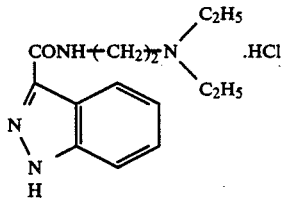

VI-19

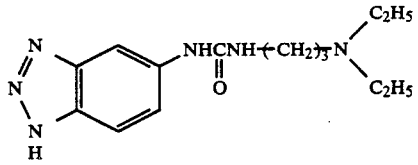

The general formula (VII) is shown below:

(VII)

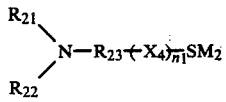

in which $R_{21}$ and $R_{22}$ each represents a hydrogen atom or an aliphatic group; or $R_{21}$ and $R_{22}$ may be bonded together to form a ring $R_{23}$ represents a divalent aliphatic group; $X_4$ represents a divalent hetero ring containing nitrogen, oxygen and/or sulfur atom(s); $n_1$ represents 0 or 1; $M_2$ represents a hydrogen atom, an alkali metal, an alkaline earth metal, a quaternary ammonium salt, a quaternary phosphonium salt or an amidino group.

The aliphatic group for $R_{21}$ and $R_{22}$ includes, for example, an alkyl, alkenyl or alkynyl group having from 1 to 12 carbon atoms, and the group may optionally be substituted. The alkyl group includes, for example, a methyl group, an ethyl group, a propyl group, a butyl group, a hexyl group, a decyl group, a dodecyl group, an isopropyl group, a sec-butyl group, a cyclohexyl group, etc. The alkenyl group includes, for example, an allyl group, a 2-butenyl group, a 2-hexenyl group, a 2-octenyl group, etc. The alkynyl group includes, for example, a propargyl group, a 2-pentynyl group, etc. Examples of the substituents for the aliphatic group include a phenyl group, a substituted phenyl group, an alkoxy group, an alkylthio group, a hydroxyl group, a carboxyl group, a sulfo group, an alkylamino group, an amido group, etc.

$R_{21}$ and $R_{22}$ may together form a ring, which may be a 5-membered or 6-membered carbon ring or hetero ring comprising carbon atoms only or a combination of carbon and nitrogen and/or oxygen atoms. In particular, saturated rings are preferred, for example,

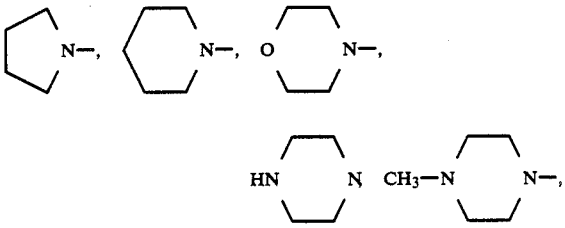

$R_{21}$ and $R_{22}$ are especially preferably an alkyl group having from 1 to 3 carbon atoms, and more preferably an ethyl group.

The divalent aliphatic group for $R_{23}$ is preferably $—R_{24}—$ or $—R_{24}S—$, wherein $R_{24}$ represents a divalent aliphatic group, and preferably a saturated or unsaturated divalent aliphatic group having from 1 to 6 carbon atoms, for example, $—CH_2—$, $—CH_2—CH_2—$, $—(CH_2)_3—$, $—(CH_2)_4—$, $—(CH_2)_6—$, $—CH_2CH=CHCH_2—$, $—CH_2C{\equiv}CCH_2—$,

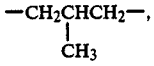

etc.

$R_{24}$ preferably has from 2 to 4 carbon atoms, and is more preferably $—CH_2CH_2—$ or $—CH_2CH_2CH_2—$. When $n_1$ is 0 in $(X_4)n$, $R_{23}$ means only $—R_{24}—$.

The hetero ring for $X_4$ is a 5-membered or 6-membered hetero ring containing nitrogen, oxygen and/or sulfur atoms, and the ring may be condensed with a benzene ring. The hetero ring is preferably an aromatic ring, which includes, for example, a tetrazole, a triazole, a thiadiazole, an oxadiazole, an imidazole, a thiazole, an oxazole, a benzimidazole, a benzothiazole, a benzoxazole, etc. Tetrazole and thiadiazole rings are especially preferred among them.

The alkali metal for $M_2$ includes, for example, $Na^{\oplus}$, $k^+$, $Li^+$, etc.

The alkaline earth metal for $M_2$ includes, for example, $Ca^{++}$, $Mg^{++}$, etc.

The quaternary ammonium salt for $M_2$ has from 4 to 30 carbon atoms, which includes, for example, $(CH_3)_4N^{\oplus}$, $(C_2H_5)_4N^{\oplus}$, $(C_4H_9)_4N^{\oplus}$, $C_6H_5CH_2N^{\oplus}(CH_3)_3$, $C_{16}H_{33}N^{\oplus}(CH_3)_3$, etc.

The quaternary phosphonium salt for $M_2$ includes, for example, $(C_4H_9)_4P^{\oplus}$, $C_{16}H_3P^{\oplus}(CH_3)_3$, $C_6H_5CH_2P^{\oplus}(CH_3)$, etc.

Examples of inorganic acid salts of the compounds of formula (VII) include hydrochlorates, sulfates, phosphates, etc.; and those of organic salts thereof include acetates, propionates, methanesulfonates, benzenesulfonates, p-toluenesulfonates, etc.

Examples of the compounds of formula (VII) are mentioned below.

VII-1

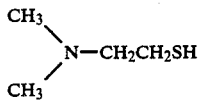

VII-2

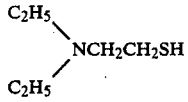

VII-3

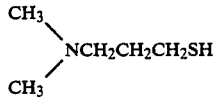

VII-4

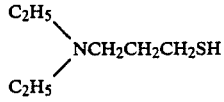

-continued

VII-5

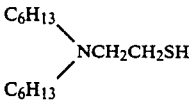

VII-6

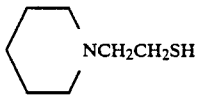

VII-7

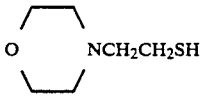

VII-8

$(HOCH_2CH_2)_2NCH_2CH_2SH$

VII-9

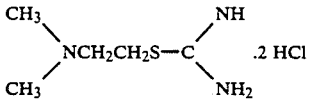

VII-10

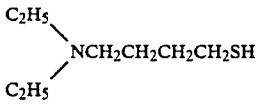

VII-11

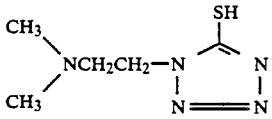

VII-12

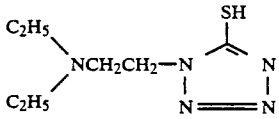

VII-13

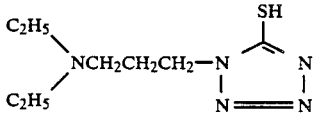

VII-14

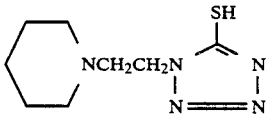

VII-15

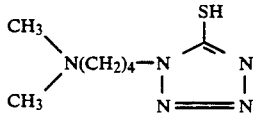

VII-16

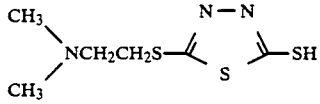

VII-17

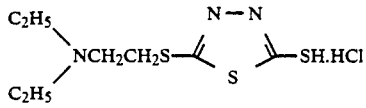

VII-18

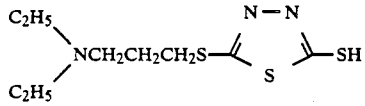

-continued

VII-19

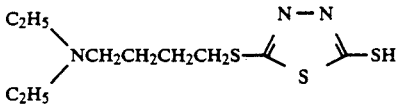

VII-20

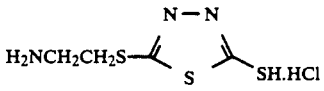

VII-21

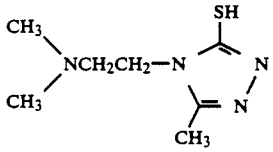

VII-22

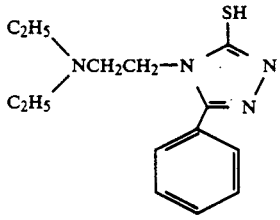

The present invention is especially effective, when applied to a photographic system containing an organic desensitizer.

The organic desensitizer for use in the present invention preferably has at least one water-soluble group or an alkali-dissociating group. The present inventors are the first to find that the incorporation of the organic desensitizer into a hydrazine compound-containing high contrast photographic material is effective for lowering the sensitivity of the material without retarding the high contrast thereof. The organic desensitizer preferably has at least one water-soluble group, which is, for example, a sulfonic acid group, a carboxylic acid group, a phosphonic acid group, etc. The said water-soluble group may form a salt with an organic base (e.g., ammonia, pyridine, triethylamine, piperidine, morpholine, etc.), or an alkali metal (e.g., sodium, potassium, etc.), etc.

The alkali-dissociating group for the desensitizer means a group which may be subjected to a de-protonation reaction under the pH condition of the development-processing solution (in general, falling within the range of from pH 9 to pH 13, but as the case may be, some processing solutions may have a pH condition outside of this range) or below the pH range condition so that the resulting group may be anionic. For example, the alkali-dissociating group includes a substituted or unsubstituted sulfamoyl group, a substituted or unsubstituted carbamoyl group, a sulfonamido group, an acylamino group, a substituted or unsubstituted ureido group or the like substituent, which has at least one hydrogen atom bonded to the nitrogen atom in the group, or a hydroxyl group.

In addition, a nitrogen-containing heterocyclic group which has at least one hydrogen atom bonded to the nitrogen atom constituting the hetero ring is also includes in the scope of the alkali-dissociating group.

The water-soluble group and alkali-dissociating group may be bonded to any moiety of the organic desensitizer, and the organic desensitizer may contain two or more of the groups in one molecule.

Preferred examples of the organic desensitizers for use in the present invention include the compounds represented by the following formulae (VIII) to (X):

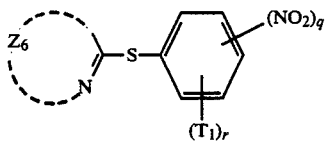

(VIII)

wherein $Z_6$ represents a non-metallic atomic group necessary for forming a nitrogen-containing hetero ring, which may further have substituent(s); $T_1$ represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, an sulfonamido group, a sulfo group, or a benzo-condensed ring, which may further have substituent(s); and q represents 1, 2 or 3; r represents 0, 1 or 2,

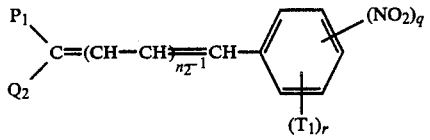

(IX)

wherein $P_1$ and $Q_2$ may be the same or different and each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group, a substituted or unsubstituted aryl group; $n_2$ represents 1, 2 or 3; and $T_1$, r and q have the same meanings as in formula (VIII),

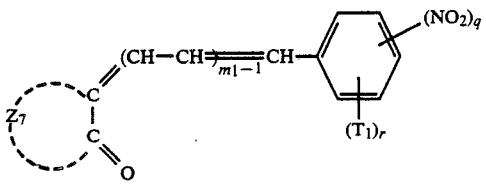

(X)

wherein $Z_7$ represents a non-metallic atomic group necessary for forming a ketomethylene ring, for example, a pyrazolone ring, an isooxazole ring, an oxyindole ring, a barbituric ring, a thiobarbituric ring, a rhodanine ring, an imidazo[1,2-a]pyridone ring, a 2-thio-2,4-oxazolidinedione ring, a 2-thio-2,5-thiazolidinedione ring, a thiazolidone ring, a 4thiazolone ring, a 2-imino-2,4-oxazolinone ring, a 2,4-imidazolinedione ring (hydantoin ring), a 2-thiohydantoin ring, a 5-imidazolone ring, etc; $m_1$ represents 1, 2 or 3; and $T_1$, r and q have the same meanings as in formula (VIII).

In the present invention, it is preferred to incorporate the organic desensitizer in the silver halide emulsion layer of the photographic material in an amount of from $1.0\times10^{-8}$ to $1.0\times10^{-4}$ mol/m$^2$, and especially from $1.0\times10^{-7}$ to $1.0\times10^{-5}$ mol/m$^2$.

Examples of the compounds of formulae (VIII) to (X) are mentioned below, which, however, are not intended to limit the scope of the present invention.

VIII-1

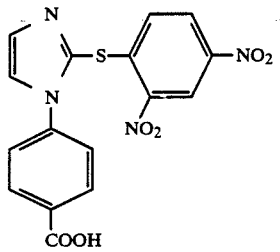

VIII-2

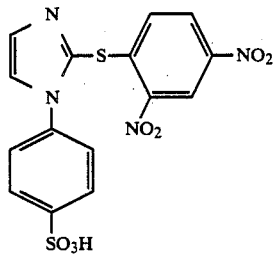

VIII-3

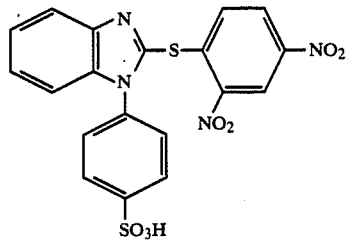

-continued
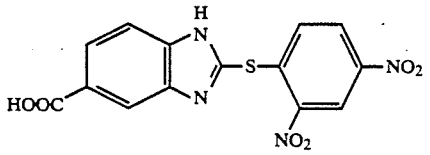
VIII-4
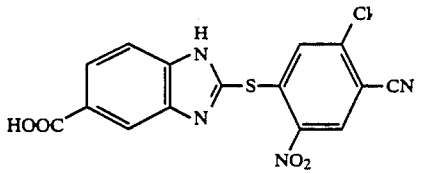
VIII-5
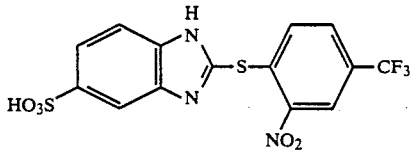
VIII-6
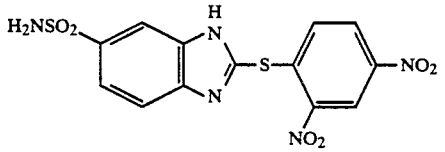
VIII-7
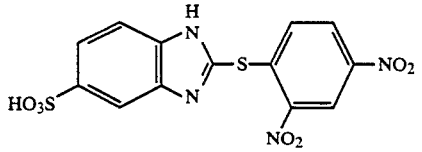
VIII-8
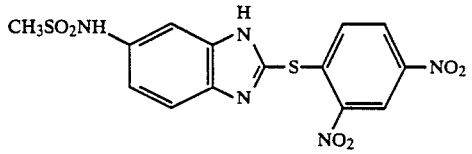
VIII-9
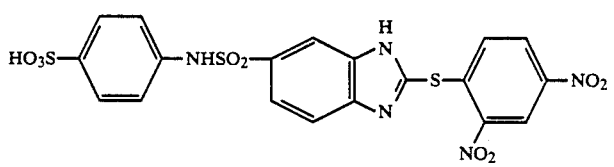
VIII-10
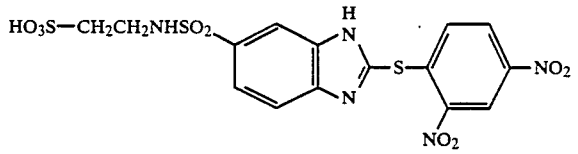
VIII-11
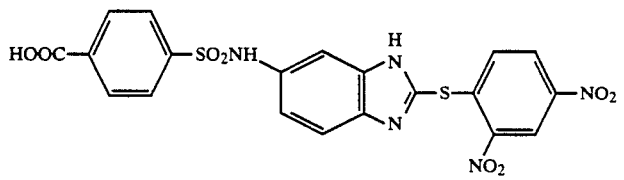
VIII-12

-continued
VIII-13
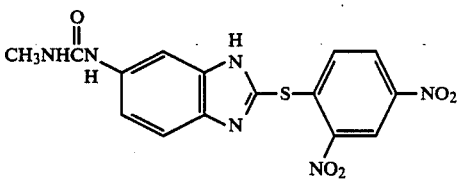
VIII-14
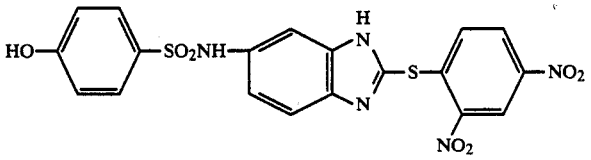
VIII-15
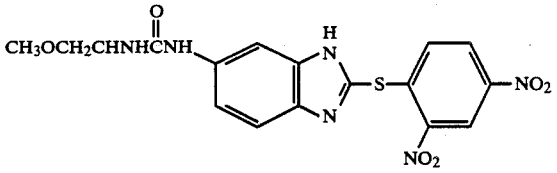
VIII-16
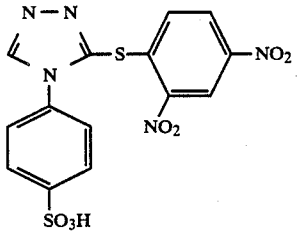
VIII-17
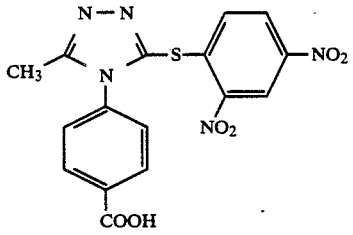
VIII-18
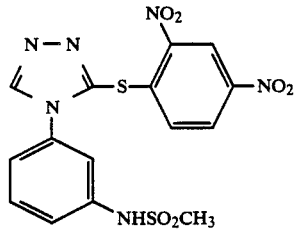
VIII-19
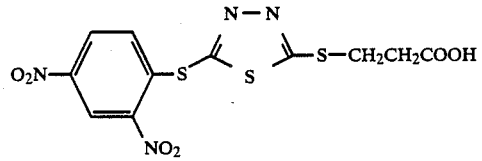

-continued
VIII-20
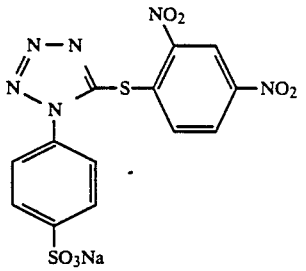
VIII-21
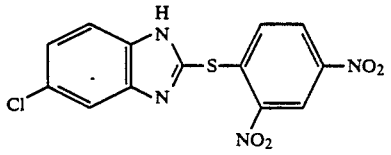
VIII-22
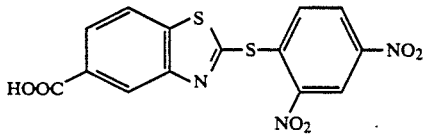
VIII-23
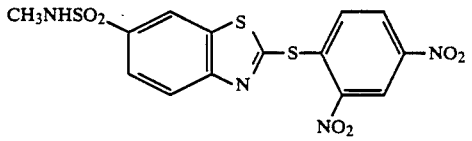
IX-1
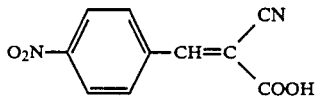
IX-2
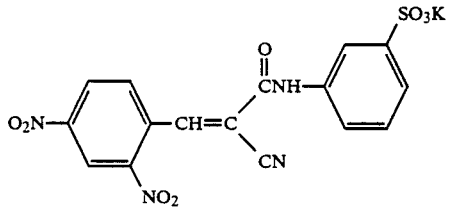
IX-3
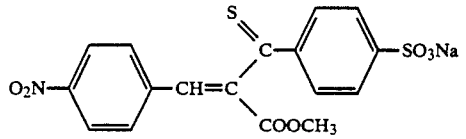
IX-4
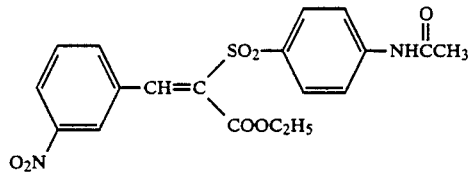
IX-5
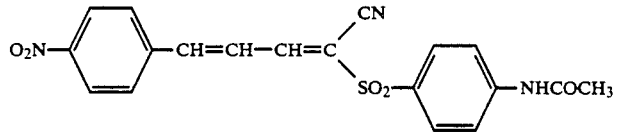

-continued
IX-6
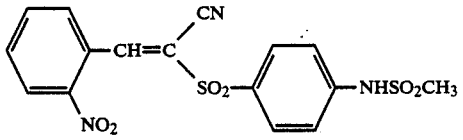
X-1
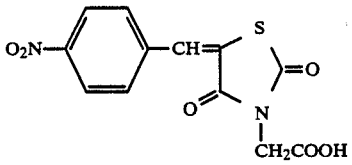
X-2
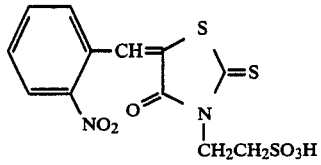
X-3
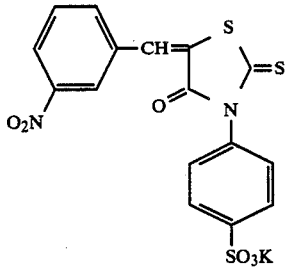
X-4
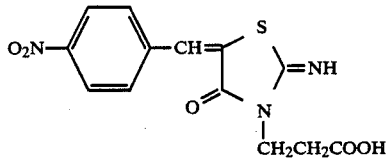
X-5
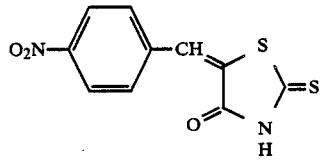
X-6
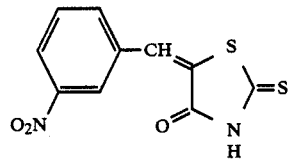
X-7
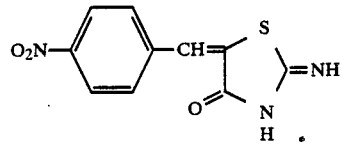

-continued

X-8

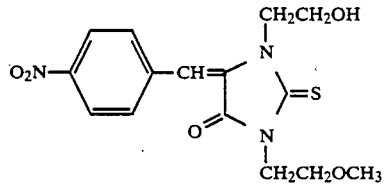

X-9

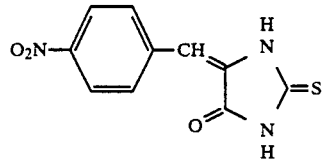

X-10

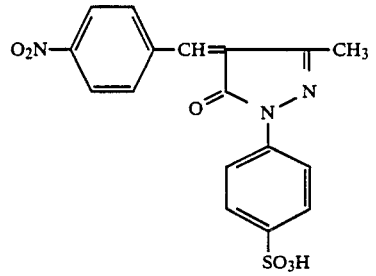

The photographic material of the present invention can contain a water-soluble dye in the emulsion layer or other hydrophilic colloid layer, as a filter dye or for the purpose of anti-irradiation or for any other various purposes. As a filter dye, a dye capable of further lowering the photographic sensitivity, preferably an ultraviolet absorbent having a spectral absorption maximum in the intrinsic sensitivity range of the silver halide in the photographic material is used or a dye having a substantial light absorption mainly in the range of from 340 nm to 600 nm is used so as to elevate the safety to the safelight when the material is handled as a daylight photographic material.

The dye is added to the emulsion layer in accordance with the object thereof or it is preferred to fix the dye in the non-light-sensitive hydrophilic colloid layer positioned above the silver halide emulsion layer, the hydrophilic colloid layer being farther from the support than the silver halide emulsion layer, together with a mordant agent.

The ultraviolet absorbent is generally added in an amount falling within the range of from $10^{-2}$ g/m to 1 g/m$^2$, although the amount depends upon the molar absorbancy index of the absorbent. Preferably, the amount is from 50 mg/m$^2$ to 500 mg/m$^2$.

The ultraviolet absorbent can be added to the coating composition, after dissolved in a pertinent solvent, such as water, an alcohol (e.g., methanol, ethanol, propanol, etc.), acetone, methyl cellosolve or a mixed solvent thereof.

As the ultraviolet absorbent can be used, for example, aryl group-substituted benzotriazole compounds, 4-thiazolidone compounds, benzophenone compounds, cinnamic acid ester compounds, butadiene compounds, benzoxazole compounds as well as ultraviolet absorbing polymers.

Specific examples of the ultraviolet absorbents are described in U.S. Pat. Nos. 3,533,794, 3,314,794, 3,352,681, Japanese Patent Application (OPI) No. 2784/71, U.S. Pat. Nos. 3,705,805, 3,707,375, 4,045,229, 3,700,455, 3,499,762, West German Patent Application (OLS) No. 1,547,863, etc.

Examples of the ultraviolet absorbent compounds for use in the present invention are mentioned below, which, however, are not intended to limit the scope of the present invention.

(1)

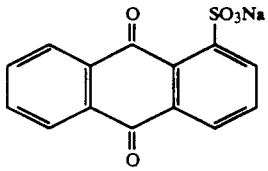

(2)

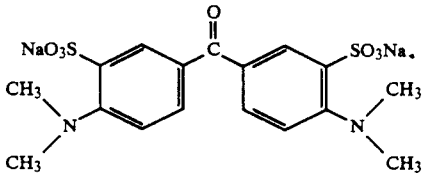

(3)

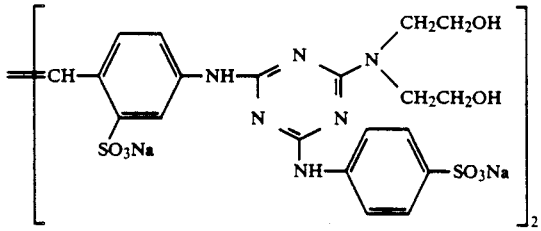

(4)

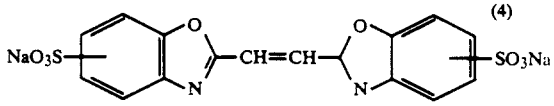

-continued (5)

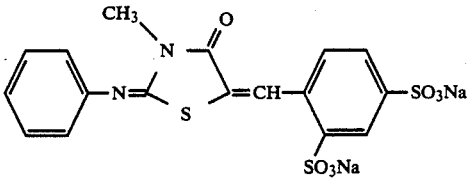

(6)

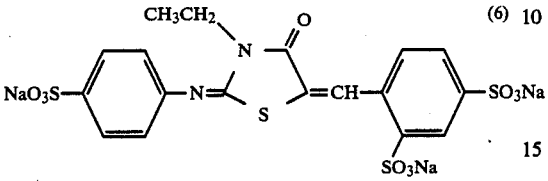

(7)

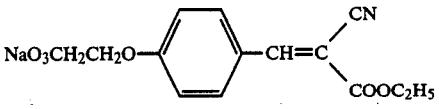

(8)

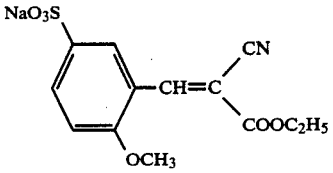

(9)

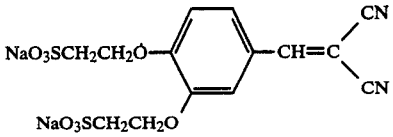

The filter dye for use in the present invention includes oxonole dyes, hemioxonole dyes, styryl dyes, merocyanine dyes, cyanine dyes and azo dyes. Among these dyes, those which are soluble in water or which can discolor in the presence of an alkali or sulfite ion are preferred, from the viewpoint of minimizing the color retention after development.

Specifically, pyrazoloneoxonole dyes, diarylazo dyes, styryl dyes, butadienyl dyes, merocyanine dyes, oxonole dyes and enaminohemioxonole dyes are used.

More preferred examples of the dyes for use in the present invention are the compounds having anyone of the following formulae (XI) to (XVI).

(XI)

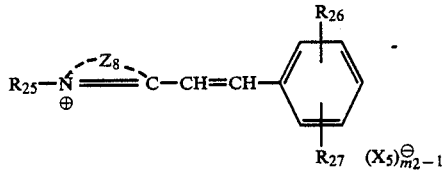

(XII)

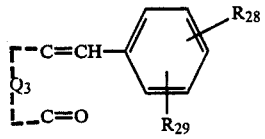

(XIII)

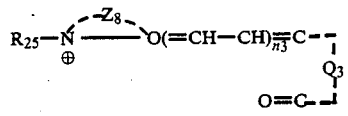

-continued (XIV)

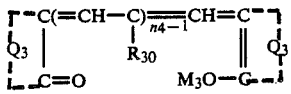

In these formulae, $Z_8$ represents a non-metallic atomic group necessary for forming a hetero-ring such as a benzothiazole, a naphthothiazole or benzoxazole; $Q_3$ represents an atomic group necessary for forming a pyrazolone, a barbituric acid, a thiobarbituric acid, an isoxazolone, a 3-hydroxythionasphthene or a 1,3-indanedione; $R_{25}$ represents a substituted or unsubstituted alkyl group, $R_{26}$, $R_{27}$, $R_{28}$ and $R_{29}$ each represents a hydrogen atom, an alkoxy group, a dialkylamino group or a sulfone group; $R_{30}$ represents a hydrogen atom or a halogen atom; $M_3$ represents a hydrogen atom, a sodium atom or a potassium atom; $X_5$ represents an anion; $m_2$, $n_3$ and $n_4$ each represents 1 or 2; provided that when m is 1, the compound forms an internal salt.

(XV)

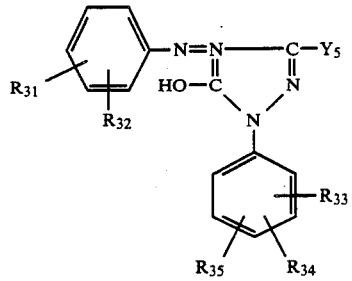

(XVI)

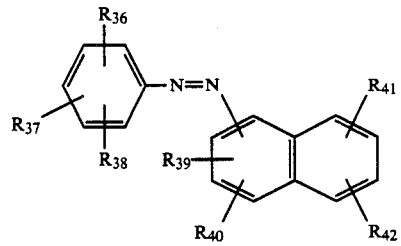

In these formulae, $Y_5$ represents an alkyl group or a carboxyl group; $R_{31}$, $R_{32}$, $R_{33}$, $R_{34}$, $R_{35}$, $R_{36}$, $R_{37}$, $R_{38}$, $R_{39}$, $R_{40}$, $R_{41}$, and $R_{42}$ each represents a hydrogen atom, an alkyl group, a hydroxyl group, an amino group, an acylamino group, a carboxyl group or a sulfone group; provided that $R_{37}$ and $R_{38}$ may be bonded together to form a ring.

Among the dyes of formulae (XI) to (XVI), those having an acid group (e.g., sulfone group, carboxyl group, etc.) are preferred.

Preferred examples of the dyes are mentioned below.

1.

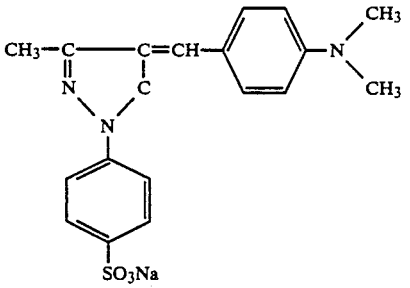

2.

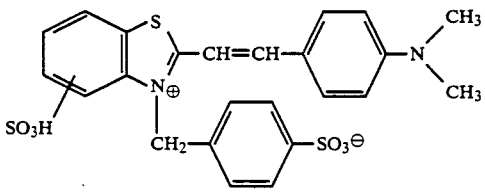

3.

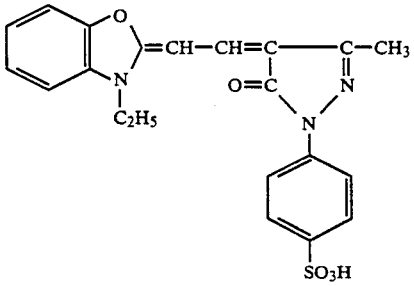

4.

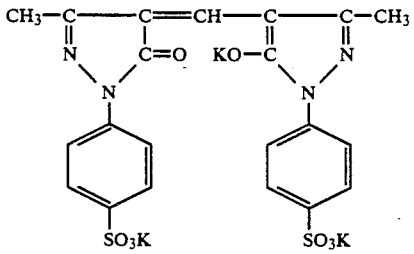

5.

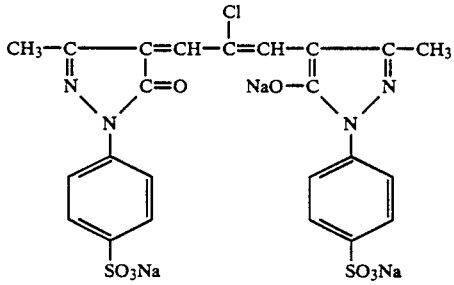

6.

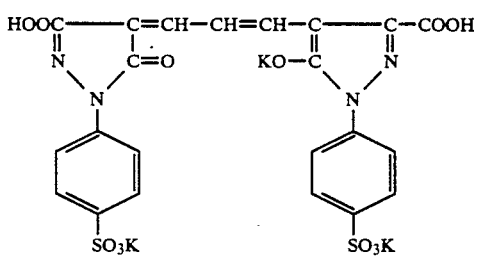

-continued

7.

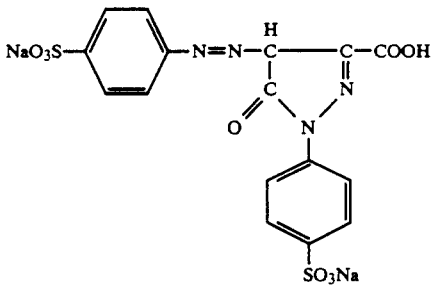

8.

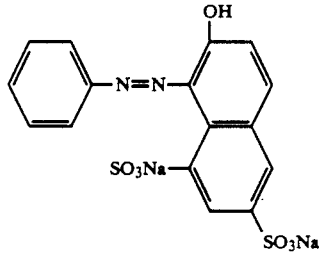

These dyes can be used in combination of two or more of them.

The dye is added to the photographic material in a necessary amount enough to make the material possible for daylight use.

Specifically, the amount of the dye to be used can be found preferable to fall generally within the range of from $10^{-3}$ g/m$^2$ to 1 g/m$^2$, and especially preferably within the range of from $10^{-3}$ g/m$^2$ to 0.5 g/m$^2$.

The term "photographic material for daylight use" as used herein refers to photographic materials which can be used for a long period of time (not less than 5 minutes) under safelight (200 lux) not having a wavelength in the ultraviolet portion but consisting substantially of a wavelength of 400 nm or longer, without substantial changes in the photographic properties such that the 50% dot image can be reproduced only with change in the dot area of not more than 2% and increase in fog of not more than 0.02.

Gelatin is advantageously used as the binder or protective colloid for the photographic emulsion of the present invention, but any other hydrophilic colloid can also be used. For instance, cellulose derivatives such as carboxymethyl cellulose, etc., saccharide derivatives such as dextran, starch derivatives, etc., as well as various kinds synthetic hydrophilic polymer substances of homo- or co-polymers such as polyvinyl alcohol, polyvinyl alcohol partial acetal, poly-N-vinylpyrrolidone, polyacrylic acid, polyacrylamide, etc., can be used.

As gelatin, an acid-processed gelatin as well as a lime-processed gelatin can be used.

The silver halide emulsion for use in the present invention may not be chemical-sensitized, but may be chemical-sensitized. For chemical sensitization of silver halide emulsions are known a sulfur sensitization method, a reduction sensitization method and a noble metal sensitization method, and anyone of the said methods can be used alone or in combination for chemical sensitization of the emulsions of the present invention.

Of the noble metal sensitization method, a typical example is a gold sensitization method where a gold compound, or mainly a gold complex, is used. In this method, complexes of other noble metals than gold, such as platinum, palladium, iridium, etc., can be used with no trouble.

As a sulfur sensitizer, the sulfur compounds contained in gelatin as well as other various kinds of compounds such as thiosulfates, thioureas, thioazoles, rhodanines, etc., can be used.

As a reduction sensitizer, stannous salts, amines, formamidinesulfinic acid, silane compounds, etc. can be used.

The compounds of the above-mentioned formula (II), (III) or (IV) for use in the present invention can be incorporated into a developing solution to be used for processing the photographic materials of the present invention.

The photographic materials of the present invention can contain an inorganic or organic hardening agent in the photographic emulsion layer or other hydrophilic colloid layers. For instance, chromium salts, aldehydes (e.g., formaldehyde, glutaraldehyde, etc.), N-methylol compounds, active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids, epoxy compounds, etc. can be used alone or in the form of a combination for this purpose.

The photographic materials of the present invention can contain various kinds of surfactants in the photographic emulsion layer or other hydrophilic colloid layers, for various purposes such as a coating aid, static charge prevention, slide property improvement, emulsification and dispersion, surface blocking prevention and photographic characteristic improvement (such as acceleration of developability, enhancement of contrast and elevation of sensitivity), etc.

The surfactants which can be used for the purposes include, for example, non-ionic surfactants such as saponin (steroid type), alkyleneoxide derivatives (e.g., polyethylene glycol, polyethylene glycol/polypropylene glycol condensation product, polyethylene glycol-alkylethers or polyethylene glycol-alkylarylethers, polyethylene glycol esters, polyethylene glycol-sorbitan esters, polyalkylene glycolalkylamines or amides, silicone-polyethylene oxide adducts, etc.), glycidol derivatives (e.g., alkenylsuccinic acid polyglycerides, alkylphenol polyglycerides, etc.), fatty acid esters of polyhydric alcohols, alkyl esters of saccharides, etc.; anionic surfactants containing an acid group such as a carboxy group, a sulfo group, a phospho group, a sulfuric acid ester group or a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-actyl-N-alkyltaurines, sulfosuccinic acid esters, sulfoalkyl-polyoxyethylenealkylphenylethers, polyoxyethylenealkylphosphoric acid esters, etc.; ampholytic surfactants such as amino acids, aminoalkylsulfonic acids, aminoalkylsulfuric acid or phosphoric acid esters, alkylbetaines, amine-oxides, etc.; cationic surfactants such as alkylamine salts, aliphatic or aromatic quaternary ammonium salts, heterocyclic quaternary ammonium salts (e.g., pyridiniums, imidazoliums, etc.), aliphatic or heterocyclic ring-containing phosphonium or sulfonium salts, etc.; as well as anionic, cationic, nonionic or ampholytic fluoro-hydrocarbon surfactants, etc.

The surfactants which are preferably used in the present invention are the polyalkyleneoxides having a molecular weight of 600 or more, described in Japanese Patent Publication No. 9412/83. In addition, a polymer latex such as polyalkyl acrylates can also be incorporated into the photographic material of the present invention, for improving the dimension stability thereof.

The silver halide photographic materials of the present invention do not require conventional infectious developers or the high alkali developers having a pH value of near 13, described in U.S. Pat. No. 2,419,975, so as to obtain the ultra-high contrast photographic characteristic, but any stable developers can be applied to the materials.

That is, the silver halide photographic materials of the present invention can be processed with a developer containing a sulfite ion as a preservative in an amount of 0.15 mol/liter or more and having a pH value of from 10.5 to 12.3, especially from 11.0 to 12.0, whereby a sufficiently ultra-high contrast negative image can be obtained.

The developing agent for the photographic materials of the present invention is not specifically limitative. For example, dihydroxybenzenes (e.g., hydroquinone), 3-pyrazolidones (e.g., 1-phenyl-3-pyrazolidone, 4,4-dimethyl- 1-phenyl-3-pyrazolidone), aminophenols (e.g., N-methyl-p-aminophenol), etc. can be used as the developing agent, alone or in the form of a combination thereof.

The silver halide photographic materials of the present invention are preferably processed with a developer containing a dihydroxybenzene compounds as the main developing agent and 3-pyrazolidone or aminophenol compound as the auxiliary developing agent. More preferably, the amount of the dihydroxybenzene compound falls within the range of from 0.05 to 0.5 mol/liter, and that of the 3-pyrazolidone or aminophenol compound is 0.06 mol/liter or less, in the developer of this type.

As described in U.S. Pat. No. 4,269,929, an amine compound can be added to the developer so as to elevate the developing speed and to shorten the developing time.

The developer can further contain, in addition to the above-mentioned components, a pH buffer such as alkali metal sulfites, carbonates, borates and phosphates, a development inhibitor or an anti-foggant such as bromides, iodides and organic anti-foggants (especially preferably nitroindazoles and benzotriazoles), etc. In addition, this may further contain a water softener, a solubilization aid, a toning agent, a development accelerator, a surfactant (especially preferably the above-mentioned polyalkylene oxides), a defoaming agent, a hardening agent, a film silver stain inhibitor (e.g., 2-mercaptobenzimidazole-sulfonic acids, etc.), etc.

As a fixing solution, one having a conventional composition can be used. As the fixing agent can be used thiosulfates and thiocyanates, as well as other organic sulfur compounds which are known to have a function as a fixing agent. The fixing solution can contain a water-soluble aluminium salt as a hardening agent.

The processing temperature for the photographic materials of the present invention is generally selected from the range of from 18° C. to 50° C.

The photographic processing is preferably conducted by the use of an automatic developing machine. When the materials of the present invention are processed with an automatic developing machine, the total processing time from the introduction of the material into the machine to the taking-out of the material therefrom may be set to be from 90 seconds to 120 seconds, and even by such shortened processing, a photographic characteristic of a sufficiently high-contrast negative gradation can be obtained.

The developer to be used for processing the photographic materials of the present invention can contain the compound described in Japanese Patent Application (OPI) No. 24347/81 as a silver stain inhibitor. As the solubilization aid to be added to the developer, the compound described in Japanese Patent Application (OPI) No. 267759/86 can be used. As the pH buffer to be added to the developer, the compound described in Japanese Patent Application (OPI) No. 93433/85 or the compound described in Japanese Patent Application (OPI) No. 186259/87 can be used.

The following examples are intended to illustrate the present invention but not to limit it in any way.

The developer used in the following examples had the composition mentioned below.

| Developer: | |
|---|---|
| Hydroquinone | 45.0 g |
| N-Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Ethylenediamine-tetraacetic acid disodium salt | 1.0 g |
| Potassium bromide | 6.0 g |
| 5-Methylbenzotriazole | 0.6 g |
| N-Butyl-diethanolamine | 15.0 g |
| Water to make | 1 liter (pH = 11.6) |

EXAMPLE 1

Aqueous silver nitrate solution (B) and aqueous sodium chloride solution (C) were added to aqueous gelatin solution (A), kept at 38° C., by the double jet method, whereupon the potential was controlled as indicated in Table 1 below and the time required for completing the addition of solution (B) was 12 minutes. The measurement of the potential was conducted by the use of a metal silver electrode and a double junction type saturated calomel reference electrode. The potential control was conducted by detecting the difference of the potential from the determined potential value with automatical control of the amount of solution (C) to be added in accordance with the detected value.

After the completion of the addition, a 1-phenyl-5-mercaptotetrazole solution was added to terminate the physical ripening, and then the grain size was measured with an electron microscope and the grain shape was observed therewith. The results are shown in Table 1 below.

| | | |
|---|---|---|
| (A) | Lime-processed gelatin | 10 g |
| | NaCl | 0.2 g |
| | $H_2O$ up to | 1000 cc |
| (B) | $AgNO_3$ | 150 g |
| | $H_2O$ up to | 300 cc |
| (C) | NaCl | 54 g |
| | $H_2O$ up to | 300 cc |

TABLE 1

| Emulsion No. | Addition time and Potential Set: Period of from 0 to 4 minutes after the addition (mV) | Period of from 4 to 12 minutes after the addition (mV) | Mean grain Size (μm) | Grain Shape |
|---|---|---|---|---|
| 1- a | +600 | +600 | 0.09 | Cubic |
| b | " | +450 | 0.085 | " |
| c | " | +80 | 0.085 | " |
| d* | " | +50 | 0.19 | Somewhat roundish cubic |
| e | +500 | +650 | 0.085 | Cubic |
| f | " | +450 | 0.075 | " |
| g | " | +80 | 0.075 | " |
| h* | " | +50 | 0.18 | Somewhat roundish cubic |
| i | +450 | +600 | 0.08 | Cubic |
| j | " | +450 | 0.07 | " |
| k | " | +80 | 0.07 | " |
| l+ | " | +50 | 0.16 | Somewhat roundish cubic |
| m | +250 | +600 | 0.09 | Cubic |
| n | " | +450 | 0.08 | " |
| o | " | +80 | 0.08 | " |
| p* | " | +50 | 0.18 | Somewhat roundish cubic |
| q | +80 | +600 | 0.12 | Cubic |
| r | " | +450 | 0.10 | " |
| s | " | +80 | 0.10 | " |
| t* | " | +50 | 0.19 | " |
| u* | +50 | +600 | 0.18 | " |
| v* | " | +80 | 0.18 | " |
| w* | " | +50 | 0.20 | " |

*Comparison

The Table 1 above indicates that silver halide grains having a grain size of 0.15μ or less can be obtained by controlling the potential in the grain formation to fall within the range of from +80 to +600 mV. In particular, it further indicates that finer grains can be obtained by controlling the potential to be higher in the first half of the addition period.

COMPARATIVE EXAMPLE 1

After formation of the grains of Emulsion 1-i, 1-k, 1-l, 1-m, 1-q or 1-t in Example 1, a hexene/maleic acid copolymer was added as a flocculating agent and the pH of the emulsion was made to be 3.0 so that the emulsion was flocculated. The resulting supernatant was removed and then water was added for washing. The desalting operation was repeated twice. The 1N-NaOH (10 cc), gelatin (35 g) and $H_2O$ (200 cc) were added, the pH value was made to be 6.0 and 2-methyl-4-hydroxy-1,3,3a,7-tetrazaindene was added and dispersed. The thus prepared emulsion was designated as Emulsion 2-I, 2-K, 2-L, 2-M, 2-Q or 2-T. The grain size and the grain shape of the grains in these emulsions were observed with an electron microscope. The results are shown in Table 2 below.

TABLE 2

| Emulsion No. | After grain formation (μm) | After flocculation and dispersion (μm) | Grain shape after flocculation and dispersion |
|---|---|---|---|
| 2 - I | 0.08 | 0.09 | Spherical |
| K | 0.07 | 0.08 | " |
| L | 0.16 | 0.18 | Somewhat roundish cubic |
| M | 0.09 | 0.10 | Spherical |

TABLE 2-continued

| Emulsion No. | After grain formation (μm) | After flocculation and dispersion (μm) | Grain shape after flocculation and dispersion |
|---|---|---|---|
| Q | 0.12 | 0.14 | Somewhat roundish cubic |
| T | 0.19 | 0.19 | Cubic |

From Table 2 above, it is noted that when the grain size is small, the fluctuation of the grain size and the grain shape is large after desalting.

EXAMPLE 2

Aqueous silver nitrate solution (B) and aqueous sodium chloride solution (C) were added to aqueous gelatin solution (A), kept at 38° C., by the double jet method for grain formation. Solution (B) was divided into two parts, ($B_1$) and ($B_2$), and the former was added over the course of four minutes in the first half stage and the latter over the course of 8 minutes in the second half stage, the addition time being 12 minutes in total. The addition was conducted by a constant flow rate addition. One minute pause was provided between the first addition and the second, additions. The potential in the grain formation was adjusted to fall within the range as indicated in Table 3 below, by controlling the addition speed of solution ($C_1$) and solution ($C_2$) and the timing of the addition of solutions ($B_1$), ($C_1$) and ($B_2$), ($C_2$). The measurement of the potential, the measurement of the grain size and the observation of the grain shape were conducted in the same manner as those in Example 1. The results are shown in Table 3 below.

| | | |
|---|---|---|
| (A) | Lime-processed gelatin | 10 g |
| | NaCl | 0.2 g |
| | $H_2O$ up to | 1000 cc |
| ($B_1$) | $AgNO_3$ | 75 g |
| | $H_2O$ up to | 150 cc |
| ($B_2$) | $AgNO_3$ | 75 g |
| | $H_2O$ up to | 150 cc |
| ($C_1$) | NaCl | 27 g |
| | $H_2O$ up to | 150 cc |
| ($C_2$) | NaCl | 27 g |
| | $H_2O$ up to | 150 cc |

TABLE 3

| Emulsion No. | Potential Measured in Grain Formation: First half of the addition period (mV) | Second half of the addition period (mV) | Mean Grain Size (μm) | Grain Shape |
|---|---|---|---|---|
| 3 - a* | +50–80 | 80–350 | 0.17 | Cubic |
| b | +80–250 | " | 0.13 | " |
| c | +250–350 | " | 0.09 | " |
| d | +350–450 | " | 0.07 | " |
| e | +450–+500 | " | 0.07 | " |
| f | +250–+500 | " | 0.075 | " |
| g | +500–+600 | " | 0.085 | " |
| h* | +350–450 | 50–80 | 0.17 | Somewhat roundish |

TABLE 3-continued

| Emulsion No. | Potential Measured in Grain Formation: First half of the addition period (mV) | Second half of the addition period (mV) | Mean Grain Size (μm) | Grain Shape |
|---|---|---|---|---|
| | - | | | cubic |

*Comparison

As seen in Table 3 above, for the same reason as in Example 1, grains having a mean grain size of 0.15μ or less can be obtained by the constant addition rate method even when the potential in the grain formation step is controlled within a particular range.

COMPARATIVE EXAMPLE 2

Emulsion 3-a, 3-b, 3-c, 3-d or 3-h prepared in Example 2 were flocculated, washed with water and, after the addition of NaOH, gelatin, $H_2O$ and 2-methyl-4-hydroxy-1,3,3a,7-tetrazaindene, dispersed in the same manner as in Comparative Example 1, and the grain size and the grain shape of the grains in the resulting dispersion were observed. The results are shown in Table 4 below.

TABLE 4

| Emulsion No. | Mean Grain Size: After grain formation (μm) | After dispersion (μm) | Grain shape after dispersion |
|---|---|---|---|
| 4 - A | 0.20 | 0.20 | Cubic |
| B | 0.13 | 0.15 | Somewhat roundish cubic |
| C | 0.10 | 0.12 | Roundish cubic |
| D | 0.07 | 0.08 | Spherical |
| H | 0.17 | 0.17 | Cubic |

From Table 4 above, it is noted that the grain size and the grain shape of the grains which were formed by a constant rate addition method and which had a mean grain size of 0.15μ or less also fluctuated.

EXAMPLE 3

Immediately after the formation of the grains of Emulsion 3-d prepared in Example 2, Compound I-1, I-2 or I-16 (which falls within the scope of the above-mentioned formula (I)) was added in the amount as indicated in Table 5 below. After being left as such for about 10 minutes, a formaldehyde condensation product of sodium naphthalenesulfonate was added as a flocculating agent and the pH value was adjusted to the value as indicated in Table 5 below. The same desalting operation as in Comparative Example 1 was conducted twice, and then 1N-NaOH (10 cc), gelatin (35 g) and $H_2O$ (200 cc) were added for dispersion, and 4 cc of NaCl (10% aq.) was further added to adjust the pH to be 6.0 and the pAg to be 7.2. The resulting emulsion was not chemical-sensitized. The grain size and the grain shape of the grains of the emulsion were observed with an electron microscope. The results are shown in Table 5 below.

TABLE 5

| Emulsion No. | Compound No. | Amount Added (g/mol-$AgNO_3$) | pH in Flocculation and Washing | Mean Grain Size (μm) | Grain Shape |
|---|---|---|---|---|---|
| 5-D (1)* | I-1 | 0 | 3.8 | 0.10 | Roundish cubic |
| (2) | " | 0.2 | " | 0.075 | Cubic |

TABLE 5-continued

| Emulsion No. | Compound No. | Amount Added (g/mol-$AgNO_3$) | pH in Flocculation and Washing | Mean Grain Size (μm) | Grain Shape |
|---|---|---|---|---|---|
| (3) | " | 1 | " | 0.07 | " |
| (4) | " | 5 | " | 0.07 | " |
| (5) | I-2 | 1 | " | 0.08 | " |
| (6) | " | 5 | " | 0.07 | " |
| (7) | I-16 | 1 | " | 0.085 | " |
| (8) | " | 5 | " | 0.07 | " |
| (9)* | I-1 | 1 | 2.8 | 0.10 | Spherical |
| (10)* | " | 1 | 3.0 | 0.08 | " |
| (11) | " | 1 | 3.4 | 0.075 | Cubic |
| (12) | " | 1 | 3.6 | 0.07 | " |
| (13) | " | 1 | 4.2 | 0.07 | " |
| (14) | " | 1 | 4.8 | 0.07 | " |

*Comparison

From Table 5 above, it is noted that the compound of formula (I) and the pH value in flocculation step are important so as to make the grain size and the grain shape hardly fluctuate.

EXAMPLE 4

Compound (I-1) was further added to each of Emulsion 5-D(1), 5-D(3), 5-D(4), 5-D(5) or 5-D(7) as prepared in Example 3, each in an amount of 0.2 g/mol-Ag, and the resulting emulsions were designated as Emulsion 6-D(1'), 6D(3'), 6-D(4'), 6-D(5') or 6-D(7'), respectively.

The emulsions were dissolved at 40° C. for 10 hours and then the fluctuation of the grain size and the grain shape were observed. The results are shown in Table 6 below.

TABLE 6

| | Compound of (I-1) (Added in Dispersion) | Before Dissolved Grain Size (μm) | Before Dissolved Grain Shape | After Dissolved Grain Size (μm) | After Dissolved Grain Shape |
|---|---|---|---|---|---|
| 5-D(1)* | not added | 0.10 | Roundish cubic | 0.16 | Spherical |
| 5-D(3)* | " | 0.07 | Cubic | 0.08 | Somewhat roundish cubic |
| 5-D(4)* | " | 0.07 | " | 0.075 | " |
| 5-D(5)* | " | 0.08 | " | 0.10 | " |
| 5-D(7)* | " | 0.085 | " | 0.13 | " |
| 6-D(1') | added | 0.10 | Roundish cubic | 0.10 | Roundish cubic |
| 6-D(3') | " | 0.07 | Cubic | 0.07 | Cubic |
| 6-D(4') | " | 0.07 | " | 0.07 | " |
| 6-D(5') | " | 0.08 | " | 0.08 | " |
| 6-D(7') | " | 0.083 | " | 0.085 | " |

*Comparison

From Table 6 above, it is noted that the addition of the compound of formula (I) in the dispersion (for post-ripening) is effective for preventing the fluctuation of the grain size and the grain shape after the dissolution of the emulsion.

EXAMPLE 5

In the grain formation of Emulsion 3-a, 3-b, 3-c, 3-d or 3-h in Example 2, $(NH_4)_3RhCl_6$ was added to halogen solutions ($C_1$) and ($C_2$) in an amount of $2.5\times10^{-5}$ mol/mol-Ag and $7.5\times10^{-5}$ mol/mol-Ag, respectively, the total of the $(NH_4)_3RhCl_6$ added being $1\times10^{-4}$ mpl/mol-Ag. The resulting emulsion was desalted in the same manner as Emulsion 6-D(3') of Example 4 and then dispersed to obtain a primitive emulsion. The thus prepared emulsions were designated as Emulsions 7-a, 7-b, 7-c, 7-d and 7-h.

70 mg/m² of Hydrazine Compound V-30 and 50 mg/m² of Nucleating Accelerator VI-8 were added to each of Emulsions 7-a, 7-b, 7-c, 7-d, 7-h and 6-D(3'), and a polyethyl acrylate latex was further added thereto in an amount of 30 wt % as a solid content to gelatin, and 1,3-vinylsulfonyl-2-propanol was also added thereto as a hardening agent in an amount of 41 mg per g of gelatin coated. The resulting composition was coated on a polyester support in an amount of 3.8 g/m² as silver. The gelatin content in the thus formed emulsion layer was 1.8 g/m². A protective layer of gelatin (1.0 g/m²) was superposed over the emulsion layer. The thus prepared samples were designated as Samples 7-A, 7-B, 7-C, 7-D, 7-H and 7-F.

These samples were exposed with a daylight printer P706 (by Dainippon Screen Co.) through an optical wedge, developed with the above-mentioned developer for 30 seconds at 38° C., fixed, rinsed with water and dried. The photographic results obtained are shown in Table 7 below.

TABLE 7

| Sample No. | Emulsion No. | Grain Size (μm) | Sensitivity | G | Letter Clearance |
|---|---|---|---|---|---|
| 7-A* | 7 - a | 0.20 | −2.06 | 6 | C |
| 7-B | b | 0.13 | −2.05 | 15 | B |
| 7-C | c | 0.09 | −2.03 | 20 | A |
| 7-D | d | 0.07 | −2.0 | 30 | A |
| 7-H* | h | 0.17 | −2.05 | 9 | C |
| 7-F | 6-D(3') | 0.07 | standard | 45 | A |

*Comparison

Using the photographic material sample, a positive original film having Ming-style letters of a 6th grade size was printed by contact printing with a P607 Printer through two sheets of a 100μ thick transparent sandwich base (PET base), whereupon the exposure was such that the dot area by contact exposure could be 1/1 (i.e., the dot area of 50% was reproduced by contact exposure through a dot image of 50% in dot area). Next, the thus printed sample was processed in the same manner as described above. The letter clearing image quality of the negative film obtained was evaluated. The evaluation was conducted by three grades, where "A" means satisfactory clearance of the 6th grade letters, "B" means somewhat insufficient but practical clearance thereof, and "C" means insufficient and impractical clearance thereof.

The sensitivity was designated by the difference ΔlogE in the sensitivity point at a density of 1.5, taking that of Sample 7-F as being a base.

$\overline{G}$ was calculated as follows.

$$\overline{G} = \frac{3.0 - 0.3}{\text{Difference in Sensitivity Point Between Density 3.0 and 0.3}}$$

The above results indicate that the photographic material samples in which the grains in the emulsion had the grain size range as defined by the invention were excellent in the high value G and the good letter clearing quality, in spite of the remarkable lowering of the sensitivity because of the addition of Rh.

EXAMPLE 6

In the same manner as in the preparation of Emulsion 7-d in Example 5, except that the amount of $(NH_4)_3RhCl_6$ to be added to halogen solutions ($C_1$) and ($C_2$) was varied to $5\times10^{-6}$ mol/mol-Ag and 0 mol/mol-Ag, respectively, another emulsion was prepared. This was designated as Emulsion 8-d.

To the emulsion was added the compounds of the formula (II), (III) and (IV) of the present invention, as indicated in Table 8 below. Further, a polyethyl acrylate latex was added thereto in an amount of 30 wt % as a solid content to gelatin, and 1,3-vinylsulfonyl-2-propanol was also added thereto as a hardening agent in an amount of 41 mg per g of gelatin coated. The resulting emulsion was coated on a polyester support ,in an amount of 3.8 g/m² as silver. The gelatin content in the emulsion layer thus formed was 1.8 g/m², and a protective layer of gelatin (1.0 g/m²) was superposed over the emulsion layer. The samples thus prepared were designated as Samples 8-A and 8T.

The samples, both non-exposed and after contact-exposure, were developed with the above-mentioned developer for 30 seconds at 30° C., fixed, rinsed with water and dried. The process was conducted in an automatic developing machine, FG660 (by Fuji Photo Film Co.). The liquid drip and the uneven fog (especially appearing in the back edge of film) were measured for the processed non-exposed sample films; and the Dmax was measured for the processed contact exposed sample films. The results are shown in Table 8 below.

TABLE 8

| Sample No. | Compound | Amount Added (mg/m²) | Dmax | Unevenness |
|---|---|---|---|---|
| 8 - A | not added | not added | 6.0 | Yes |
| B | II- 1 | 1 | 5.8 | No |
| C | " | 5 | 5.7 | " |
| D | " | 10 | 5.6 | " |
| E | II- 4 | 5 | 5.6 | " |
| F | II- 8 | " | 5.7 | " |
| G | II- 9 | " | 5.6 | " |
| H | II- 12 | " | 5.5 | " |
| I | II- 17 | " | 5.8 | " |
| J | II- 18 | " | 5.8 | " |
| K | II- 21 | " | 5.9 | " |
| L | II- 27 | " | 5.7 | " |
| M | II- 29 | " | 5.6 | " |
| N | III- 1 | 7.5 | 5.8 | " |
| O | III- 10 | " | 5.9 | " |
| P | III- 12 | " | 5.9 | " |
| Q | IV- 1 | 10 | 6.0 | " |
| R | IV- 2 | " | 6.0 | " |
| S | IV- 6 | " | 5.8 | " |
| T | IV- 7 | " | 5.7 | " |

Table 8 above indicates that the addition of the compound of the present invention is effective for overcoming the unevenness without substantially lowering the Dmax.

EXAMPLE 7

In the grain formation of Emulsion 3-a, 3-b, 3-c, or 3-d in Example 2, $(NH_4)_3RhCl_6$ was added to halogen solution ($C_1$) in an amount of $5\times10^{-6}$ mol/mol-Ag per the total of $AgNO_3$. The resulting emulsion was desalted in the same manner as Emulsion 6-D(3') in Example 4 and then dispersed to obtain a primitive emulsion. The emulsions thus prepared were designated as Emulsions 9-a, 9-b, 9-c and 9-d.

On the other hand, when Emulsion 9-d was prepared, KBr was added to Solution ($C_1$) in an amount of 2 mol % or 1 mol % as Br and the others were the same as Emulsion 9-d, so that other emulsions were prepared. These were designated as Emulsions 9-e and 9-f.

Also, when Emulsion 9-d was prepared, the pH value in the flocculation was varied to 3.0 or 3.2 in the same manner as in Example 3, so that other emulsions each having a different crystal habit were prepared. There were designated as Emulsions 9-g and 9-h.

In addition, the amount of $(NH_4)_3RhCl_6$ as added to Solution ($C_1$) was varied to $8\times10^{-5}$ mol/mol-Ag or $1\times10^{-4}$ mol/mol-Ag in the preparation of Emulsion 9-d, so that other emulsions were also prepared. These were designated as Emulsions 9-i and 9-j.

Using these emulsions, coated samples were prepared in the same manner as in Example 5. The samples were designated as Samples 9-A to 9-J.

These samples were evaluated in the same manner as in Example 5 with respect to the sensitivity, G, and letter clearing quality thereof. Further, the non-exposed samples were put under a UV-cut fluorescent lamp (by Toshiba, NU/M Type) of 200 lux for 20 seconds for the purpose of evaluating the safelight safety thereof. After processed, the fog value was measured. The results are shown in Table 9 below.

TABLE 9

| Sample No. | Emulsion No. | Grain Size (μm) | Halogen Composition | Crystal Habit | $(NH_4)_3RhCl_6$ (mol/mol-Ag) | Sensitivity (ΔlogE) | G | Safelight Safety (fog value) | Lett Clearance |
|---|---|---|---|---|---|---|---|---|---|
| 9-A | 9-a | 0.17 | AgCl | Cubic | $5\times10^{-5}$ | +0.20 | 7 | 0.05 | C |
| 9-B | 9-b | 0.13 | " | " | " | +0.10 | 18 | 0.04 | B |

TABLE 9-continued

| Sample No. | Emulsion No. | Grain Size (μm) | Halogen Composition | Crystal Habit | $(NH_4)_3RhCl_6$ (mol/mol-Ag) | Sensitivity (ΔlogE) | G | Safelight Safety (fog value) | Lett Clearance |
|---|---|---|---|---|---|---|---|---|---|
| 9-C | 9-c | 0.09 | " | " | " | +0.05 | 30 | 0.04 | A |
| 9-D | 9-d | 0.07 | " | " | " | standard | 45 | 0.04 | A |
| 9-E | 9-e | 0.07 | AgBrCl Br 2 mol % | " | " | +0.15 | 40 | 0.06 | A |
| 9-F | 9-f | 0.07 | " Br 1 mol % | " | " | +0.1 | 42 | 0.04 | A |
| 9-G | 9-g | 0.08 | AgCl | Spherical | " | +0.02 | 12 | 0.04 | C - A |
| 9-H | 9-h | 0.08 | " | Somewhat spherical | " | +0.02 | 15 | 0.04 | C - B |
| 9-I | 9-i | 0.07 | " | Cubic | $8 \times 10^{-5}$ | −0.15 | 40 | 0.04 | A |
| 9-J | 9-j | 0.07 | " | " | $1 \times 10^{-4}$ | −0.3 | 30 | 0.04 | A |

The results in Table 9 above indicate that when the grain size of the grains in the emulsion exceeds 0.15 μm, the contrast of the photographic material becomes soft, the letter clearing quality thereof lowers and the safelight safety thereof worsens. In addition, when the content of Br (wt %) increases, the safelight safety also worsens so that the photographic material cannot be put in practical use. When the crystal habit of the emulsion grains is spherical, the G value lowers and the letter clearing quality worsens even though the grain size of the emulsion grains is small. Further, when the grain size is small, the G value is high and good letter clearing quality can be maintained even when the amount of the rhodium salt added is large.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support, wherein the emulsion layer(s) comprises cubic silver halide grains having a mean grain size of 0.15 μm or less and containing silver chloride in an amount of 99 mol % or more.

2. The silver halide photographic material as in claim 1, wherein the mean grain size of the grains falls within the range of from 0.05 to 0.13 82 μm.

3. The silver halide photographic material as in claim 2, wherein the mean grain size of the grains falls within the range of from 0.05 to 0.11 μm.

4. The silver halide photographic material as in claim 1, wherein the silver halide is silver chloride.

5. The silver halide photographic material as in claim 1, wherein the silver halide emulsion layer(s) contains at least one of the compounds of the following formulae (I) to (III):

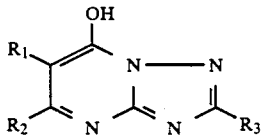

(I)

wherein $R_1$, $R_2$ and $R_3$ each represents a hydrogen atom, an alkyl group, an amino group, a derivative of an alkyl group, a derivative of an amino group, a halogen atom, an aryl group, a derivative of an aryl group or —CONH—$R_4$, wherein $R_4$ represents a hydrogen atom, an alkyl group, an amino group, a derivative of an alkyl group, a derivative of an amino group, a halogen atom, an aryl group or a derivative of an aryl group;

$$Z_1—SH \quad (II)$$

wherein $Z_1$ represents an aliphatic group, an aromatic group or a heterocyclic group, which may be substituted; and

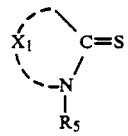

(III)

wherein $R_5$ represents an alkyl group, an aralkyl group, an alkenyl group or an aryl group; and $X_1$ represents an atomic group necessary for forming a 5-membered or 6-membered ring, which may be condensed to form a condensed ring.

6. The silver halide photographic material as in claim 1, wherein the silver halide emulsion layer contains at least one of the compounds of the following formulae (IV-1) to (IV-7).

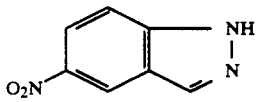

IV-1

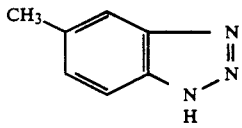

IV-2

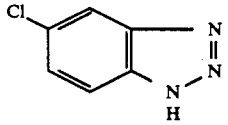

IV-3

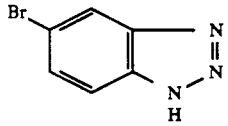

IV-4

-continued

IV-5

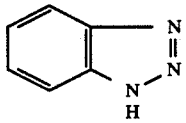

IV-6

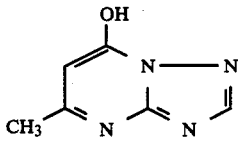

IV-7

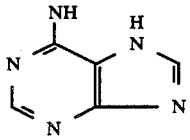

7. The silver halide photographic material as in claim 1, wherein the silver halide emulsion layer or the adjacent layer contains a compound of formula (V):

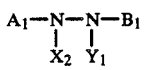

(V)

wherein $A_1$ represents an aliphatic group or an aromatic group; $B_1$ represents a formyl group, an acyl group, an alkyl- or aryl-sulfonyl group, an alkyl- or aryl-sulfinyl group, a carbamoyl group, an alkoxy- or aryloxy-carbonyl group, a sulfinamoyl group, an alkoxysulfonyl group, a thioacyl group, a thiocarbamoyl group, a sulfanyl group or a heterocyclic group; $X_2$ and $Y_1$ both are hydrogen atoms, or one of them represents a hydrogen atom and the other represents a substituted or unsubstituted alkylsulfonyl group, a substituted or unsubstituted arylsulfonyl group or a substituted or unsubstituted acyl group; provided that $B_1$ and $Y_1$ and the adjacent nitrogen atom may form a hydrazone partial structure of

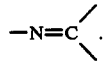

8. The silver halide photographic material as in claim 7, wherein said layer additionally contains a compound of formula (VI) or (VII):

$$Y_4\text{-}(X_3)\text{-}(_nA_2\text{—}B_2]_m \quad \text{(VI)}$$

wherein $Y_4$ represents a group capable of adsorbing to silver halide grains; $X_3$ represents a divalent linking group of an atom or an atomic group comprising a hydrogen atom, a carbon atom, a nitrogen atom, an oxygen atom, a sulfur atom or combinations thereof; $A_2$ represents a divalent linking group; $B_2$ represents an amino group, an ammonium group or a nitrogen-containing heterocyclic group, where the amino group may optionally be substituted; m represents 1, 2 or 3; and n represents 0 or 1; and

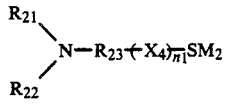

(VII)

wherein $R_{21}$ and $R_{22}$ each represents a hydrogen atom or an aliphatic group; or $R_{21}$ and $R_{22}$ may be bonded together to form a ring; $R_{23}$ represents a divalent aliphatic group; $X_4$ represents a divalent hetero ring containing nitrogen, oxygen, a sulfur atom or combinations thereof; $n_1$ represents 0 or 1; $M_2$ represents a hydrogen atom, an alkali metal, an alkaline earth metal, a quaternary ammonium salt, a quaternary phosphonium salt or an amidino group.

9. The silver halide photographic material as in claim 1, which contains an organic desensitizer selected from the compounds of the following formulae (VIII) to (X):

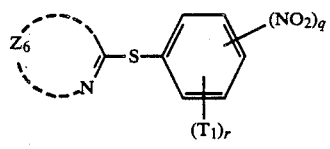

(VIII)

wherein $Z_6$ represents a non-metallic atomic group necessary for forming a nitrogen-containing hetero ring, which may further have substituent(s); $T_1$ represents an alkyl group, a cycloalkyl group, an alkenyl group, a halogen atom, a cyano group, a trifluoromethyl group, an alkoxy group, an aryloxy group, a hydroxyl group, an alkoxycarbonyl group, a carboxyl group, a carbamoyl group, a sulfamoyl group, an aryl group, an acylamino group, an sulfonamido group, a sulfo group or a benzo-condensed ring, which may further have substituent(s); and q represents 1, 2 or 3; r represents 0, 1 or 2;

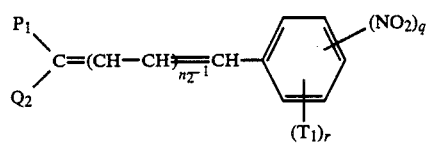

(IX)

wherein $P_1$ and $Q_2$ may be the same or different and each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group, a substituted or unsubstituted aryl group; $n_2$ represents 1, 2 or 3; and $T_1$, r and q have the same meanings as in formula (VIII); and

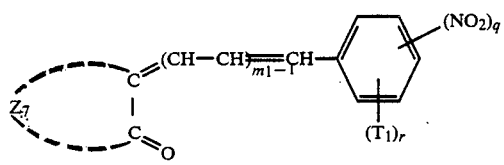

(X)

wherein $Z_7$ represents a non-metallic atomic group necessary for forming a ketomethylene ring; $m_1$ represents 1, 2 or 3; and $T_1$, r and q have the same meanings as in formula (VIII).

10. The silver halide photographic material as in claim 1, wherein the emulsion layer contains a rhodium salt in an amount of from $10^{-8}$ to $5\times10^{-4}$ mol/mol-Ag.

11. A silver halide photographic material as in claim 1, wherein the silver halide emulsion layer contains a compound which adsorbs to the surface of the silver halide crystals in the emulsion layer by bonding of the sulfur atom in the compound to the silver ion in the crystal.

12. The silver halide photographic material as in claim 1, wherein the silver halide emulsion layer contains a compound which adsorbs to the surface of the silver halide crystals in the emulsion layer by bonding of the nitrogen atom in the compound to the silver ion in the crystal.

13. The silver halide photographic material as in claim 5, wherein the compounds of formulae (II) and (III) are employed in an amount of from 0.1 mg/m$^2$ to 100 mg/m$^2$ 14. The silver halide photographic material as in claim 13, wherein the compounds of formulae (II) and (III) are employed in an amount of from 1.0 mg/m$^2$ to 50 mg/m$^2$.

15. The silver halide photographic material as in claim 6, wherein the compounds of formulae (IV-I) to (IV-7) are employed in an amount of from 0.1 mg/m$^2$ to 100 mg/m$^2$.

16. The silver halide photographic material as in claim 15, wherein the compounds of formulae (IV-1) to (IV-7) are employed in an amount of from 1.0 mg/m$^2$ to 50 mg/m$^2$.

17. The silver halide photographic material as in claim 7, wherein the compound of formula (V) is employed in an mount of from $1.0\times10^{-6}$ to $5.0\times10^{-2}$ mol/mol of silver halide.

18. The silver halide photographic material as in claim 17, wherein the compound of formula (V) is employed in an amount of from $1.0\times10^{-5}$ to $2.0\times10^{-2}$ mol/mol of silver halide.

19. The silver halide photographic material as in claim 9, wherein the organic desensitizer is employed in an amount of from $1.0\times10^{-8}$ to $1.0\times10^{-4}$ mol/m$^2$.

20. The silver halide photographic material as in claim 19, wherein the organic desensitizer is employed in an amount of from $1.0\times10^{-7}$ to $1.0\times10^{-5}$ mol/m$^2$.

* * * * *